US010579001B2

(12) United States Patent
Endoh et al.

(10) Patent No.: US 10,579,001 B2
(45) Date of Patent: Mar. 3, 2020

(54) IMAGE FORMING APPARATUS ABLE TO FORM IMAGES ON BOTH SIDES OF SHEET

(71) Applicant: CANON KABUSHIKI KAISHA, Tokyo (JP)

(72) Inventors: Keisuke Endoh, Fuji (JP); Hiroshi Hagiwara, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 176 days.

(21) Appl. No.: 15/819,207

(22) Filed: Nov. 21, 2017

(65) Prior Publication Data

US 2018/0157200 A1 Jun. 7, 2018

(30) Foreign Application Priority Data

Dec. 5, 2016 (JP) ..... 2016-236242
Oct. 2, 2017 (JP) ..... 2017-192833

(51) Int. Cl.
*G03G 15/23* (2006.01)
*G03G 15/00* (2006.01)
*G03G 21/14* (2006.01)

(52) U.S. Cl.
CPC ..... *G03G 15/234* (2013.01); *G03G 15/6564* (2013.01); *G03G 15/6579* (2013.01); *G03G 21/14* (2013.01); *G03G 2215/00599* (2013.01); *G03G 2215/00945* (2013.01); *G03G 2215/2083* (2013.01)

(58) Field of Classification Search
CPC ..... G03G 15/234; G03G 15/6564; G03G 15/6579
See application file for complete search history.

(56) References Cited

U.S. PATENT DOCUMENTS 6,577,844 B2 * 6/2003 Kamei ..... G03G 15/234 399/301
6,736,390 B2 * 5/2004 Chihara ..... B41J 3/60 271/186

(Continued)

FOREIGN PATENT DOCUMENTS

CN 100454155 C 1/2009
JP H06048605 A 2/1994

(Continued)

OTHER PUBLICATIONS

Extended European Search Report issued in European Appln. No. 17201519.0 dated Jul. 26, 2018.

(Continued)

*Primary Examiner* — Justin N Olamit
(74) *Attorney, Agent, or Firm* — Rossi, Kimms & McDowell LLP

(57) ABSTRACT

An image forming unit forms an image on a sheet. A reverse unit pulls in the sheet from a main conveyance path and reverses a conveyance direction of the sheet to feed the sheet to a sub-conveyance path. A control unit causes a conveyance unit to convey a first sheet that is waiting to the main conveyance path after a trailing end of a second sheet that has been fed from a feeding unit and follows the first sheet has passed through a merging point, and moves a trailing end of the first sheet downstream of a branch point before the second sheet reaches the branch point.

16 Claims, 21 Drawing Sheets

(56) References Cited

U.S. PATENT DOCUMENTS

| | | | |
|---|---|---|---|
| 9,580,261 | B2 | 2/2017 | Nakagaki |
| 2006/0228126 | A1 | 10/2006 | Nihei |
| 2010/0329762 | A1 | 12/2010 | Yamazaki |
| 2011/0076076 | A1 | 3/2011 | Ban |
| 2011/0085838 | A1 | 4/2011 | Won |
| 2016/0114993 | A1 | 4/2016 | Nakagaki |
| 2016/1766771 | | 6/2016 | Mizuguchi et al. |

FOREIGN PATENT DOCUMENTS

| | | | |
|---|---|---|---|
| JP | H10167542 | A | 6/1998 |
| JP | 2001019283 | A | 1/2001 |
| JP | 2002012374 | A | 1/2002 |
| JP | 2006317730 | A | 11/2006 |
| JP | 2011011827 | A | 1/2011 |
| JP | 2013010601 | A | 1/2013 |
| JP | 2014043338 | A | 3/2014 |
| JP | 2014227293 | A | 12/2014 |
| JP | 2016081007 | A | 5/2016 |

OTHER PUBLICATIONS

Partial European Search Report issued in European Application No. 17201519.0 dated Apr. 5, 2018.
Office Action issued in Chinese Appln. No. 201711269964.6 dated Aug. 23, 2019. English translation provided.

* cited by examiner

IMAGE FORMING APPARATUS ABLE TO FORM IMAGES ON BOTH SIDES OF SHEET

BACKGROUND OF THE INVENTION

Field of the Invention

The present invention relates to an image forming apparatus that is able to form images on both sides of a sheet.

Description of the Related Art

To form images on both sides of a sheet, an image forming apparatus includes an auxiliary conveyance path (sub-conveyance path) in addition to a main conveyance path (Japanese Patent Laid-Open No. 2002-12374). The sub-conveyance path is a conveyance path that branches from the main conveyance path and again merges with the main conveyance path, and is used for turning over a sheet. A sheet with an image formed on its first face is sent to the sub-conveyance path, and the proceeding direction thereof is reversed. The sheet is thus turned over and is again sent to an image forming unit in the main conveyance path, and an image is formed on the second face.

To increase productivity when forming images on both sides of a plurality of sheets, a configuration may be employed in which the plurality of sheets are successively fed, and image formation on the first face of a sheet and image formation on the second face of another sheet with an image formed on the first face may be performed alternately. However, if a long sub-conveyance path is provided in order to allow a large number of sheets to wait, the size of the image forming apparatus will increase. In addition, it is also conceivable that a leading end of a sheet that has been conveyed from the main conveyance path to the sub-conveyance path will collide with a trailing end of a sheet that is already waiting in the sub-conveyance path.

SUMMARY OF THE INVENTION

According to the present invention, the length of the sub-conveyance path is shortened while avoiding contact between a leading sheet and a following sheet in an image forming apparatus that is able to form images on both sides of a sheet.

The present invention provides an image forming apparatus comprising: a feeding unit configured to feed a sheet to a main conveyance path; an image forming unit configured to form an image on the sheet fed from the feeding unit; a reverse unit configured to pull in the sheet on which the image has been formed by the image forming unit, the sheet having been conveyed from the main conveyance path, and reverse a conveyance direction of the sheet to feed the sheet to a sub-conveyance path after a trailing end of the sheet has passed through a branch point of the main conveyance path and the sub-conveyance path; a conveyance unit configured to again convey the sheet that has been fed to the sub-conveyance path by the reverse unit, to the main conveyance path from a merging point of the sub-conveyance path and the main conveyance path; and a control unit configured to control the reverse unit and the conveyance unit so as to cause a first sheet that is fed to the sub-conveyance path by the reverse unit to wait in the sub-conveyance path, wherein the first sheet that is waiting straddles the branch point, wherein the control unit causes the conveyance unit to convey the first sheet that is waiting to the main conveyance path after a trailing end of a second sheet that has been fed from the feeding unit and follows the first sheet has passed through the merging point, and moves a trailing end of the first sheet downstream of the branch point before the second sheet reaches the branch point.

Further features of the present invention will become apparent from the following description of exemplary embodiments (with reference to the attached drawings).

DESCRIPTION OF THE EMBODIMENTS

First Embodiment

Hereinafter, embodiments of the present invention will be described in detail with reference to the drawings. However, the constituent elements described in these embodiments are merely examples, and are not intended to limit the scope of the invention thereto unless stated otherwise.

Image Forming Apparatus

Figure 1:
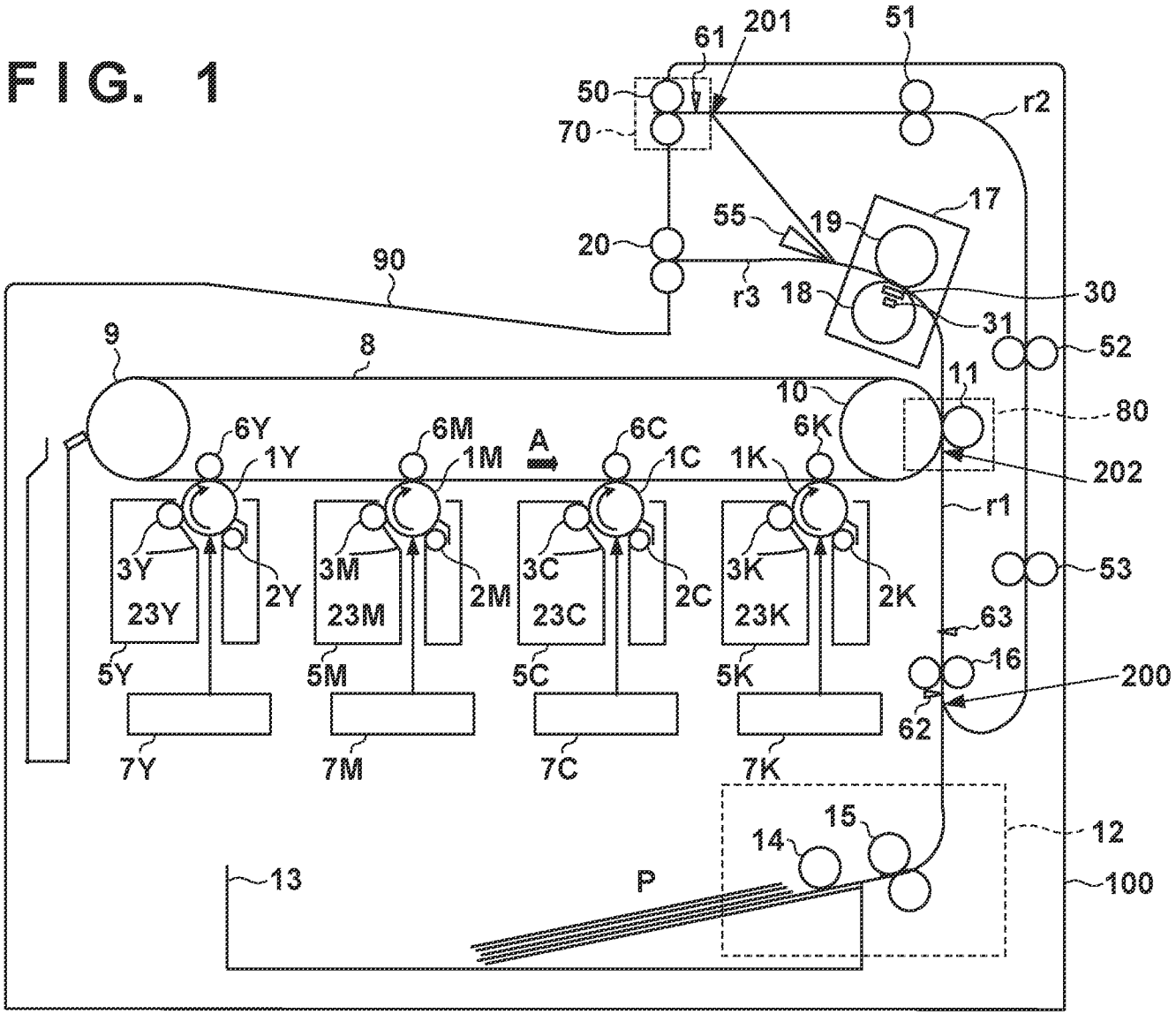
FIG. 1 is a schematic cross-sectional diagram of an image forming apparatus.

FIG. 1 shows an electrophotographic image forming apparatus 100, which forms multi-color images. Process stations (process cartridges) 5Y, 5M, 5C, and 5K are image forming units that can be attached to and detached from the image forming apparatus 100. The four process stations 5Y, 5M, 5C, and 5K have the same configuration, but toner colors thereof are different. Y, M, C, and K that follow reference signs indicate yellow, magenta, cyan, and black (K), respectively, which are the toner colors. In the following description, the characters Y, M, C, and K are omitted except for descriptions of specific process stations. Toner containers 23 are containers for storing toner. Photosensitive drums 1 are image carriers for carrying electrostatic latent images and toner images. Charging rollers 2 uniformly charge the surfaces of the corresponding photosensitive drums 1. Exposure apparatuses 7 cause a laser beam that corresponds to input image data to scan on the surface of the corresponding photosensitive drum 1, and form electrostatic latent images that correspond to the image data on the surface of the corresponding photosensitive drum 1. Each of the exposure apparatuses 7 is, in the narrow sense, an image forming unit that forms an electrostatic latent image. Note that the timing at which the exposure apparatuses 7 start to form the electrostatic latent images (image formation timing) is instructed by a later-described controller. Developing rollers 3 develop the electrostatic latent images by attaching the toner stored in the corresponding toner containers 23 to the electrostatic latent images, and form toner images. A first transfer roller 6 transfers the toner images carried by the corresponding photosensitive drum 1 to an intermediate transfer belt 8. The intermediate transfer belt 8 is wound around a driving roller 9 and an opposing roller 10 in a stretched manner, and is rotated by the driving roller 9 in a direction indicated by an arrow A. As a result of the intermediate transfer belt 8 rotating, the opposing roller 10 also rotates following the intermediate transfer belt 8.

A feeding apparatus 12 feeds sheets P to a main conveyance path r1. The main conveyance path r1 is a conveyance path that extends from a feed cassette 13 to a reverse point (turn-over point) 201 (which is also called a branch point). The feeding apparatus 12 essentially feeds sheets so that a gap between a leading sheet and a following sheet is fixed. This is because the process stations 5 form images to be transferred to the leading sheet and images to be transferred to a following sheet, on the intermediate transfer belt 8 with a fixed gap therebetween. A feeding roller 14 feeds each of the sheets P stored in the feed cassette 13 to a conveyance roller pair 15. The conveyance roller pair 15 feeds the sheet P to a registration roller pair 16. The registration roller pair 16 conveys the sheet P so that the timing at which the toner images conveyed by the intermediate transfer belt 8 arrive at a secondary transfer unit 80 coincides with the timing at which the sheet P is conveyed by the registration roller pair 16.

A secondary transfer roller 11 transfers the toner images carried by the intermediate transfer belt 8 to the sheet P. The secondary transfer roller 11 and the intermediate transfer belt 8 form the secondary transfer unit 80. Since the toner images are formed on the sheet P by the secondary transfer unit 80, the secondary transfer unit 80 is an image forming unit in the narrow sense. The sheet P nipped by the intermediate transfer belt 8 and the secondary transfer roller 11 is fed to a fixing device 17. The fixing device 17 includes a fixing roller 18 and a pressure roller 19 that is pressed against the fixing roller 18. The fixing roller 18 contains a fixing heater 30 and a temperature sensor 31 for measuring the temperature of the fixing heater 30. The toner images are fixed to the sheet P by heating and pressing the sheet P. The sheet P on which image formation has been completed is guided by a flapper 55 to a discharge path r3, which is a conveyance path that branches from the main conveyance path r1. The sheet P is discharged to a discharge tray 90 by discharge rollers 20, which are provided at an end (exit) of the discharge path r3.

In the case of forming an image on a second face of the sheet P, the flapper 55 guides the sheet P to a reverse unit 70. That is to say, the sheet P enters the reverse unit 70 from the reverse point 201, which is an exit of the main conveyance path r1, and moves toward a reverse roller pair 50. The reverse point 201 is also an entrance of the reverse unit 70. In FIG. 1, the reverse unit 70 is a conveyance path that is located on the left side of the reverse point 201, and includes the reverse roller pair 50. The reverse roller pair 50 pulls the sheet P from the main conveyance path r1 into the reverse unit 70 by rotating in a reverse direction. Thus, a portion of the sheet P is discharged outside the image forming apparatus 100. Upon a sheet sensor 61 detecting a trailing end of the sheet P, the reverse roller pair 50 stops. Upon the reverse roller pair 50 rotating in a forward direction, the sheet P is fed to a sub-conveyance path r2 via the reverse point 201. That is to say, the sheet P is turned over as a result of the direction in which the sheet P is conveyed being inverted (reversed). The reverse point 201 is also an exit of the reverse unit 70, and is also an entrance of the sub-conveyance path r2. That is to say, the reverse point 201 is a connecting point that connects the main conveyance path r1, the sub-conveyance path r2, and the reverse unit 70 to one another. The sub-conveyance path r2 is also connected to the main conveyance path r1 at a merging point 200. Thus, the sub-conveyance path r2 is an auxiliary conveyance path that extends from the reverse point 201 to the merging point 200. The merging point 200 is also an exit of the sub-conveyance path r2. In the main conveyance path r1, the merging point 200 is provided upstream of the registration roller pair 16. Upon the reverse roller pair 50 starting to rotate in the forward direction, a conveyance roller pair 51, a conveyance roller pair 52, and a conveyance roller pair 53 also start to rotate. The sheet P is conveyed by the conveyance roller pair 51, the conveyance roller pair 52, and the conveyance roller pair 53, and proceeds toward the merging point 200. The conveyance roller pair 53 may suspend the conveyance of the sheet P before the leading end of the sheet P reaches the merging point 200. As a result of the conveyance roller pair 53 resuming the conveyance of the sheet P, the sheet P passes through the merging point 200 and reaches the registration roller pair 16. After the timing of conveying the sheet P has been adjusted by the registration roller pair 16, the sheet P is conveyed to the secondary transfer unit 80. As a result of the second face of the sheet P coming into contact with the intermediate transfer belt 8, the toner images are transferred to the second face. The fixing device 17 fixes toner images to the second face of the sheet P. The flapper 55 guides the sheet P, for which duplex printing has been completed, toward the discharge path r3. Thus, the sheet P with images formed on both sides is discharged to the discharge tray 90.

Note that a sheet sensor 62 may be provided at the merging point 200. Upon the leading end of the sheet P arriving at the merging point 200, the sheet sensor 62 switches the level of a detection signal from OFF to ON. Upon the trailing end of the sheet P passing through the merging point 200, the sheet sensor 62 switches the level of the detection signal from ON to OFF. That is to say, the level of the detection signal is kept ON while the sheet P is passing the sheet sensor 62. The level of the detection signal is kept OFF while the sheet P is not passing through the sheet sensor 62. The sheet sensor 62 may be used as a sensor for detecting that the sheet P has reached the registration roller pair 16. The sheet sensor 63 is a sensor for detecting that the sheet P has passed through the registration roller pair 16, or has reached a stable-speed point 202.

Control System

Figure 2:
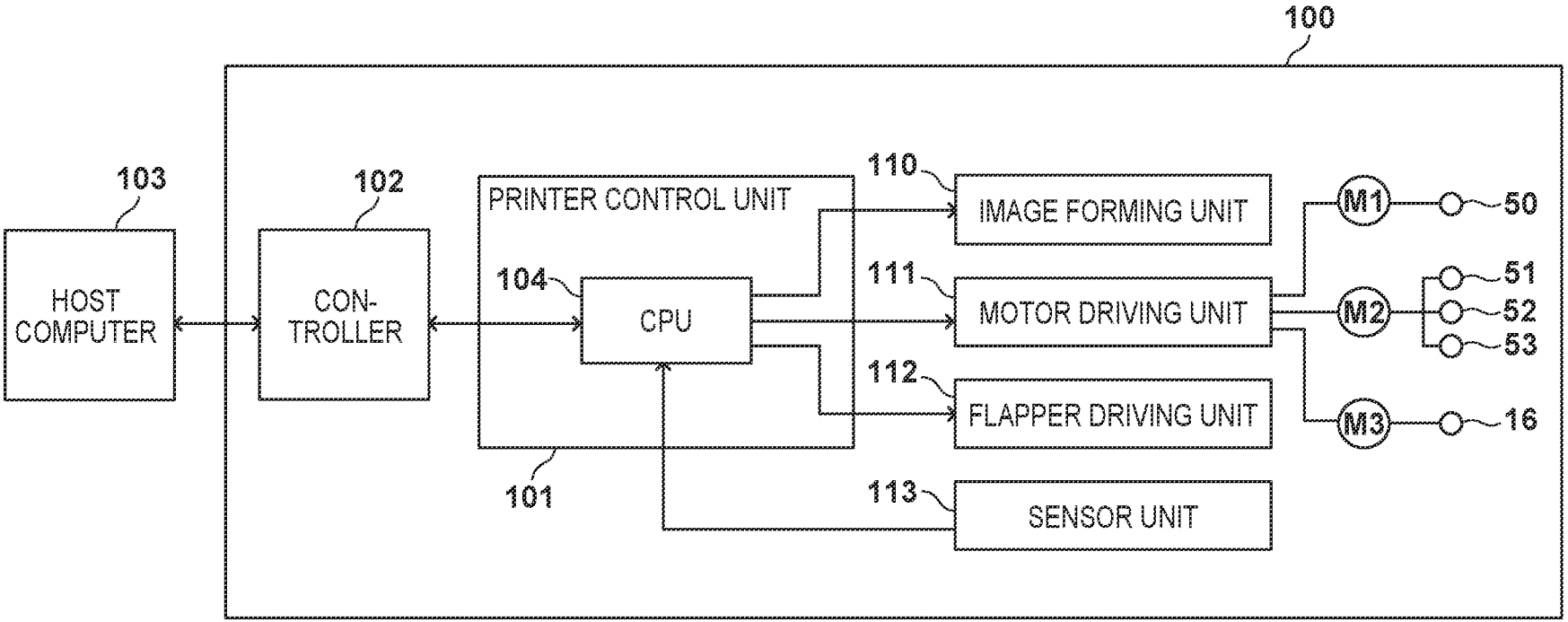
FIG. 2 is a block diagram showing a control system.

FIG. 2 shows a control system that controls the image forming apparatus 100. A printer control unit 101 has a CPU 104 and circuits such as a ROM and a RAM (not shown), and controls various units provided in the image forming apparatus 100. A control program is stored in the ROM. The CPU 104 is connected to an image forming unit 110, a motor driving unit 111, a flapper driving unit 112, and a sensor unit 113. The image forming unit 110 includes the fixing device 17, the exposure apparatuses 7, the process stations 5, and so on. The motor driving unit 111 is a drive circuit for driving motors M1, M2, and M3 in accordance with an instruction from the CPU 104. The motor M1 drives the reverse roller pair 50. The motor M2 drives the conveyance roller pairs 51, 52, and 53. The conveyance roller pairs 51, 52, and 53 may also be driven by different motors. The motor M3 drives the registration roller pair 16. Motors for driving the driving roller 9 and the like are omitted in FIGS. 3A to 3C. The flapper driving unit 112 guides the sheet P to the discharge path r3 or to the sub-conveyance path r2 by controlling the flapper 55 in accordance with a control signal that is output by the CPU 104. The sensor unit 113 is connected to the sheet sensors 61, 62, and 63, and outputs, to the CPU 104, the detection signals that are output by the sheet sensors 61, 62, and 63. Note that the CPU 104 may estimate the position of each sheet by counting the number of drive pulses supplied to the respective motors by the motor driving unit 111, instead of using these sheet sensors. The number of drive pulses is proportional to the rotation angle of a rotary shaft of each motor, and to the rotation angle of each roller. Accordingly, the distance by which the sheet P is conveyed is also proportional to the number of drive pulses.

A controller 102 is a controller for changing the color space of image data and instructing the printer control unit 101 to print. The controller 102 is connected to a host computer 103 via a network, a printer cable, or the like. The controller 102 receives image information and a print command from the host computer 103. The controller 102 analyzes the image information to convert it into bitmap data, and transmits the bitmap data to the printer control unit 101 synchronously with a TOP signal that is transmitted from the printer control unit 101. The printer control unit 101 may also be implemented as a result of the CPU 104 executing the control program. Some or all of the functions of the printer control unit 101 may also be implemented by an application specific integrated circuit (ASIC). Some or all of the functions to be performed by the CPU 104 may also be implemented by hardware such as an ASIC or an FPGA. "FPGA" is an abbreviation of field programmable gate array.

Duplex Circulation

The image forming apparatus 100 may also have a plurality of duplex printing modes. Essentially, after successively forming images on first faces of N sheets, the image forming apparatus 100 alternately performs image formation on a second face of a sheet and image formation of the first face of a sheet. That is to say, the image forming apparatus 100 alternately executes image formation on a sheet that is fed from the sub-conveyance path and image formation on a sheet that is newly fed from the feed cassette 13.

Figure 3A:
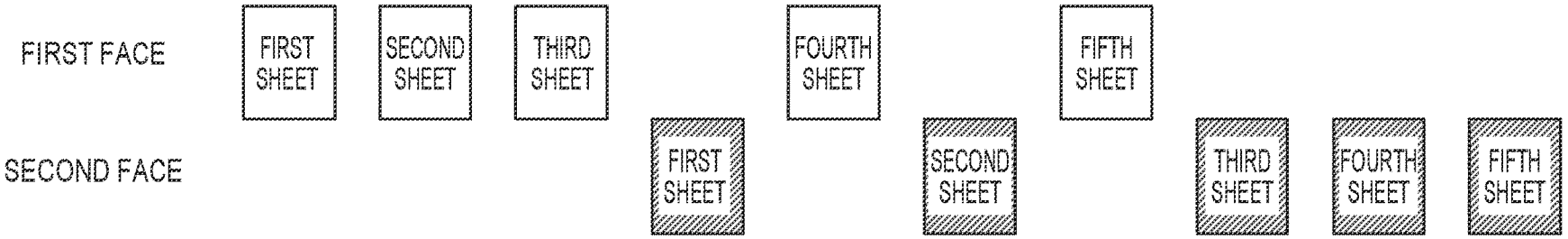
FIGS. 3A to 3C are diagrams showing a sheet conveyance order during duplex printing.

FIG. 3A shows a case where N=3. The image forming apparatus 100 successively forms images on the first faces of first to third sheets, and feeds them to the sub-conveyance path r2. Thereafter, the image forming apparatus 100 alternately executes image formation on the second face of a sheet that is fed again from the sub-conveyance path r2 and image formation on the first face of a sheet that is fed from the feeding apparatus 12. That is to say, after forming an image on the first face of the third sheet, the image forming apparatus 100 forms an image on the second face of the first sheet. Furthermore, the image forming apparatus 100 forms an image on the first face of a fourth sheet, and then forms an image on the second face of the second sheet. Furthermore, the image forming apparatus 100 forms an image on the first face of a fifth sheet, and then forms an image on the second face of the third sheet. Lastly, the image forming apparatus 100 forms an image on the second faces of the third to fifth sheets. This case shown in FIG. 3A illustrates a three-sheet circulating mode, in which three sheets circulate in the conveyance paths in the image forming apparatus 100.

Figure 3B:
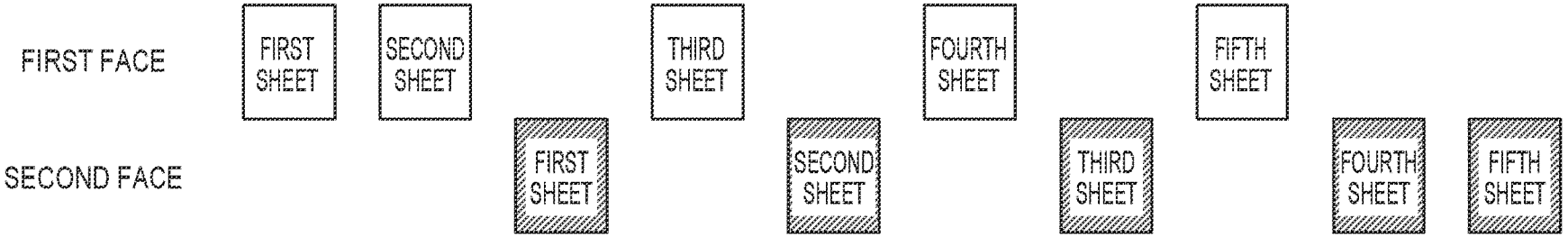
Figure 3C:
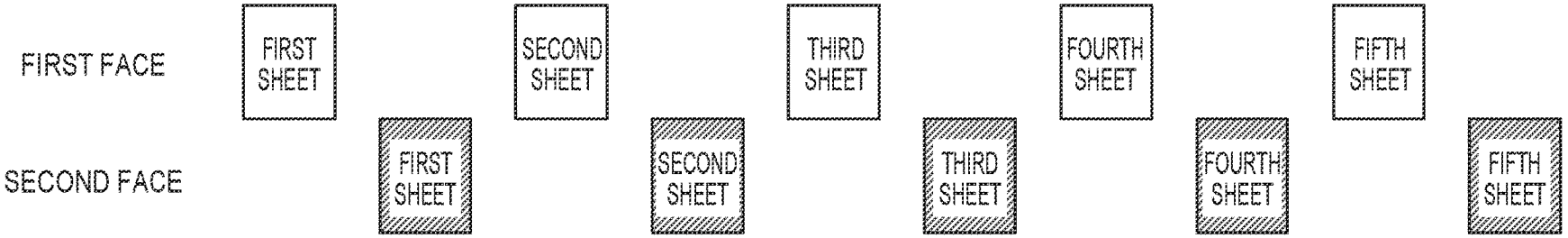

FIG. 3B shows a two-sheet circulating mode. FIG. 3C shows a one-sheet circulating mode. In the one-sheet circulating mode, the image forming apparatus 100 forms an image on the first face of a sheet, and then forms an image on the second sheet of this sheet. These circulating modes are selected in accordance with the length of the sheets in the conveyance direction.

A sheet with an image formed on the first face again reaches the secondary transfer unit 80 via the sub-conveyance path r2, and an image is formed on the second face thereof. Accordingly, the amount of time a sheet moves in the sub-conveyance path r2 affects the productivity of image formation. If an image can be formed on a following sheet while a leading sheet is moving along the sub-conveyance path r2, the moving time is not wasted, and the productivity is increased. Accordingly, the two-sheet circulating mode and the three-sheet circulating mode are more productive than the one-sheet circulating mode. Thus, the productivity will increase if sheet conveyance along the sub-conveyance path r2 is completed until the timing of transferring the toner images to the second face. Note that the number of sheets that can circulate in a circular path formed by the main conveyance path and the sub-conveyance path depends on the length of the sub-conveyance path.

It is assumed that the maximum size of the sheets P that can be printed by the image forming apparatus 100 according to this embodiment is the Ledger size. The length of a sheet P of the Ledger size in the conveyance direction is 431.8 mm. In this case, the three-sheet circulating mode can be employed in the case of a sheet P of the Letter size (215.9 mm) and the A4 size (210 mm). The two-sheet circulating mode can be employed in the case of a sheet P of the Ledger/A3 size.

Conveyance Control

Figure 4:
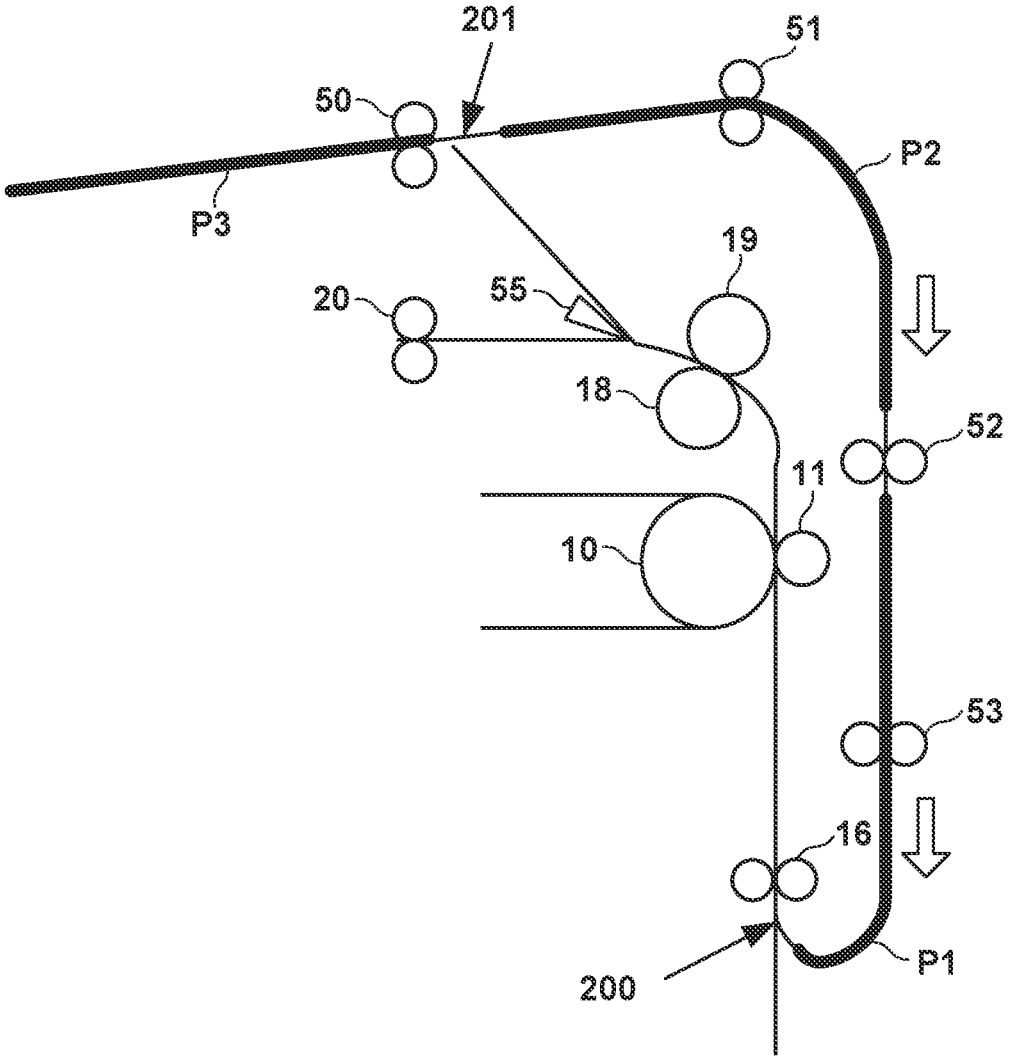
FIG. 4 is a diagram showing conveyance paths in a comparative example.

FIG. 4 shows a comparative example. The sub-conveyance path r2 in the comparative example is so long that three sheets P1, P2, and P3 can wait in a path from the reverse roller pair 50 to the merging point 200. In this embodiment, the number of sheets able to wait in the sub-conveyance path r2 is reduced by shortening the sub-conveyance path r2, whereas the image forming apparatus 100 is made compact. Upon a trailing end of a sheet P3 passing through the reverse point 201 due to the reverse rotation of the reverse roller pair 50, the CPU 104 causes the reverse roller pair 50 to start rotating in the forward direction, and also resumes conveying sheets P1 and P2.

FIGS. 5A to 5F illustrate the three-sheet circulating mode in this embodiment. It is assumed that all sheets are of the Letter/A4 size.

Figure 5A:
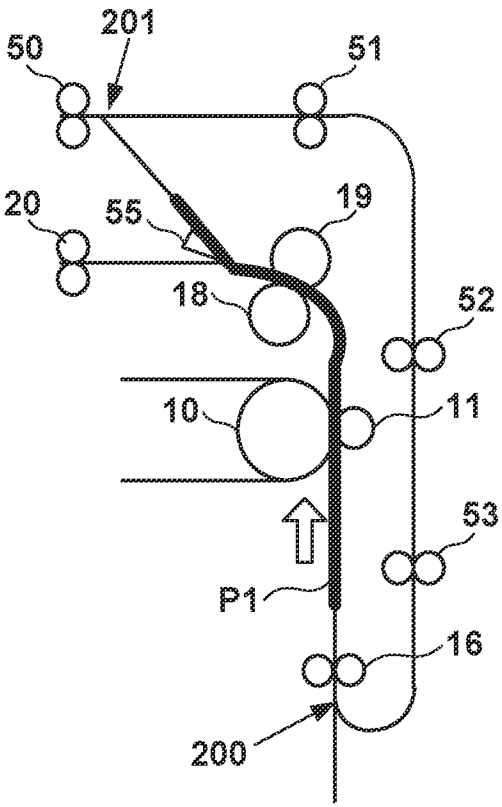
FIGS. 5A to 5F are diagrams illustrating sheet conveyance control.

1. As shown in FIG. 5A, the image forming apparatus 100 conveys a first sheet P1 with an image formed on the first face to the reverse point 201.

Figure 5B:
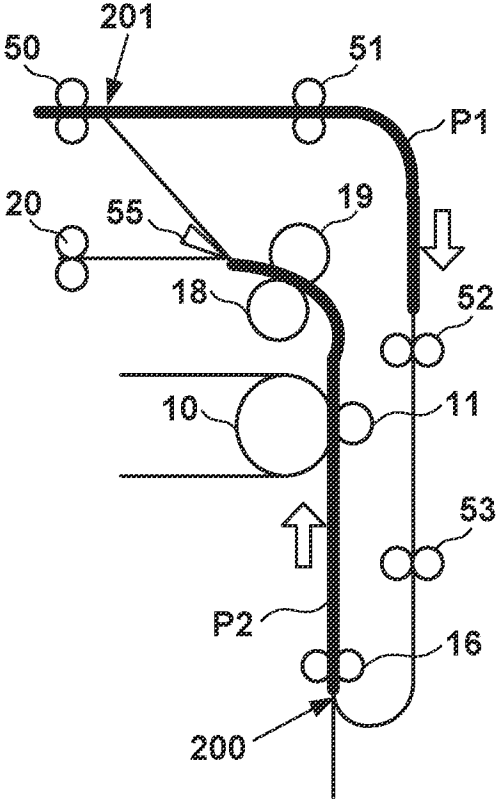

2. As shown in FIG. 5B, the image forming apparatus 100 rotates the reverse roller pair 50 in the reverse direction to pull the sheet P1 into the reverse unit 70, and thereafter rotates the reverse roller pair 50 in the forward direction. Thus, the image forming apparatus 100 feeds the sheet P1 to the sub-conveyance path, and conveys the sheet P1 toward the merging point 200. Simultaneously, the image forming apparatus 100 forms an image on the first face of a second sheet P2, and conveys the second sheet P2 to the reverse point 201.

Figure 5C:
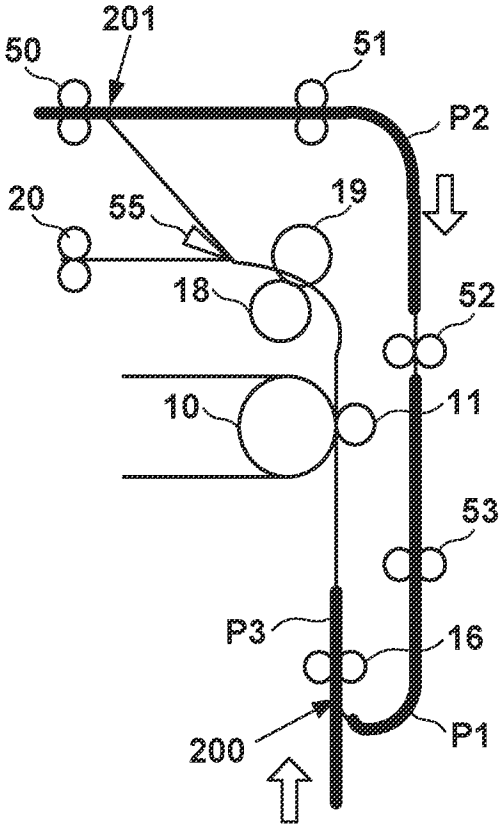

3. As shown in FIG. 5C, the image forming apparatus 100 causes the sheet P1 to stop and wait at a waiting position, which is located before the merging point 200. The image forming apparatus 100 rotates the reverse roller pair 50 in the reverse direction to pull the sheet P2 into the reverse unit 70, and thereafter rotates the reverse roller pair 50 in the forward direction. Thus, the image forming apparatus 100 feeds the sheet P2 to the sub-conveyance path r2, and conveys the sheet P2 toward the merging point 200. The image forming apparatus 100 causes the feeding apparatus 12 to feed a third sheet P3 to the main conveyance path r1. The sheet P1, which is waiting upstream of the merging point 200, does not collide with the sheet P3.

Figure 5D:
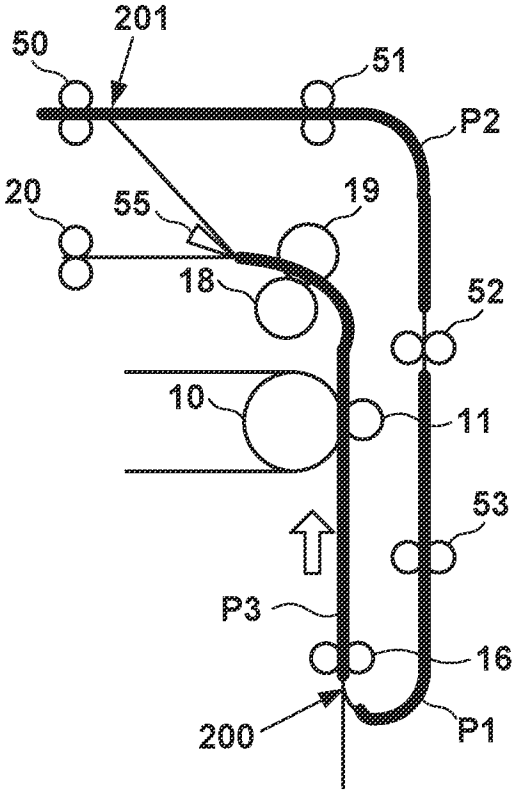

4. As shown in FIG. 5D, the sheet P1 continues to wait forward of the merging point 200 while the image forming apparatus 100 forms an image on the sheet P3. The image forming apparatus 100 causes a trailing end of the sheet P2 to be nipped by the reverse roller pair 50 to cause the sheet P2 to wait. A portion of the sheet P2 around the center thereof is nipped by the conveyance roller pair 51. A leading end of the sheet P2 stops before the conveyance roller pair 52. The image forming apparatus 100 conveys the sheet P3 toward the reverse point 201 while forming an image on the first face thereof. At the timing at which a trailing end of the sheet P3 passes through the merging point 200, the image forming apparatus 100 resumes conveying the sheet P1 and the sheet P2.

Figure 5E:
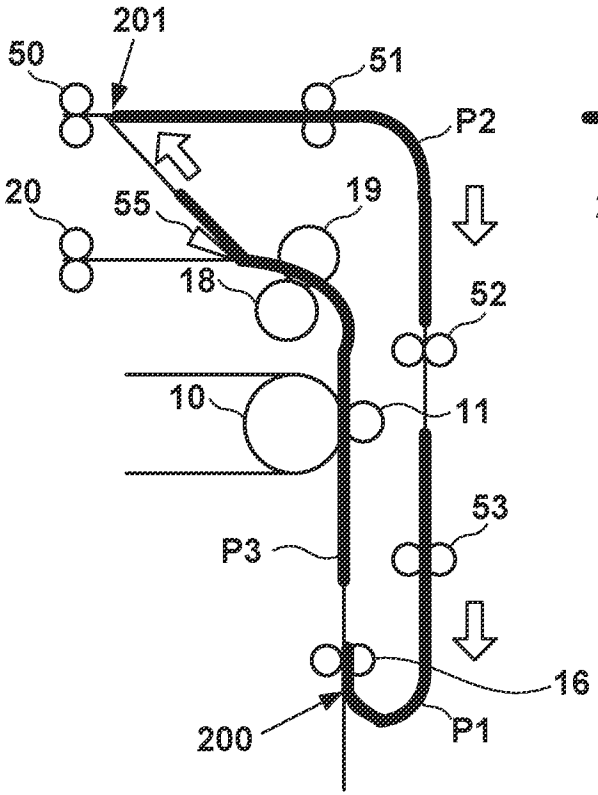

5. As shown in FIG. 5E, a leading end of the sheet P3 has not reached the reverse point 201 at the point in time when the trailing end of the trailing end of the sheet P2 passes through the reverse point 201. Accordingly, the sheet P3 does not collide with the sheet P2. The image forming apparatus 100 also conveys the sheet P1 using the conveyance roller pair 53 and feeds the sheet P1 to the main conveyance path r1.

Figure 5F:
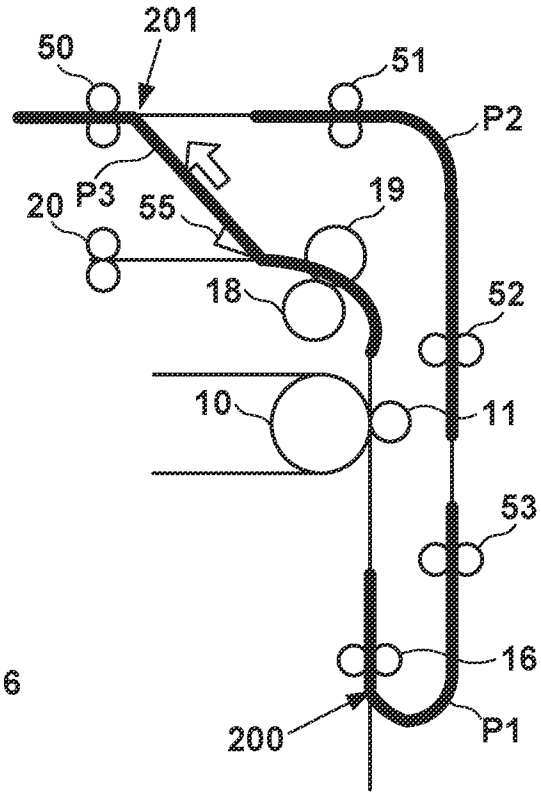

6. As shown in FIG. 5F, the image forming apparatus 100 stops the registration roller pair 16 upon the sheet P1 passing through the registration roller pair 16. Thus, the image forming apparatus 100 synchronizes the timing at which the toner images for the second face conveyed by the intermediate transfer belt 8 arrive at the secondary transfer unit 80 with the timing at which the second face of the sheet P1 arrives at the secondary transfer unit 80. Also, upon the conveyance of the sheet P1 stopping, the image forming apparatus 100 stops the conveyance of the sheet P2. The sheet P2 waits in the sub-conveyance path r2. The image forming apparatus 100 also conveys the sheet P3 toward the reverse point 201.

Thus, if the length of the sub-conveyance path is short, the trailing end and a portion therearound of the sheet P2 is obstructing the reverse point 201 at the point in time when the trailing end of the sheet P3 passes through the merging point 200. That is to say, the sheet P2 spans the reverse point 201. However, triggered by the trailing end of the sheet P3 passing through the merging point 200, the image forming apparatus 100 feeds the sheet P1 to the main conveyance path r1 from the merging point 200, and also moves the sheet P2 downstream in the sub-conveyance path f2, thereby making the reverse unit 70 and the reverse point 201 clear. Thus, the sheet P3 and the sheet P2 do not collide with each other at the reverse point 201, and the three sheets can be circulated in the circular path. In the comparative example shown in FIG. 4, the length of the sub-conveyance path is sufficiently long, and accordingly, the top sheet P1 is fed to the main conveyance path r1 after the sheet P3 has been pulled into the reverse unit 70. In contrast, in the first embodiment, the top sheet P1 is fed to the main conveyance path r1 prior to the arrival of the sheet P3 at the reverse unit 70. This feeding method may be called preceding feeding.

Upon the trailing end of the sheet P3 passing through the merging point 200, the printer control unit 101 resumes conveying the sheet P2, which has been waiting while being nipped by the reverse roller pair 50. That is to say, the trailing end of the sheet P2 passes through the reverse point 201 until the leading end of the sheet P3 reaches the reverse point 201. Accordingly, the sheet P2 and the sheet P3 do not collide with each other at the reverse point 201. Since the sheet P2 waits with its trailing end spanning the reverse roller pair 50 and the sub-conveyance path r2 as shown in FIG. 5D, the length of the sub-conveyance path r2 according to this embodiment can be made shorter than the length of the sub-conveyance path r2 in the comparative example.

According to this embodiment, the trailing end of the sheet P2 needs to move downstream of the reverse point 201 within a period of time from when the trailing end of the sheet P3 passes through the merging point 200 until the leading end of the sheet P3 reaches the reverse point 201. Accordingly, at the point in time when the trailing end of the sheet P3 passes through the merging point 200, the distance from the leading end of the sheet P3 to the reverse point 201 needs to be longer than the distance from the trailing end of the waiting sheet P2 to the reverse point 201. However, the conveyance speed of the sheets P2 and P3 is the same. Also, it is assumed in this embodiment that the length of the sheets on which images are formed is shorter than the distance along the sub-conveyance path r2 from the reverse point 201 to the merging point 200. For example, with sheets of the Ledger size, the trailing end of a sheet cannot pass through the merging point 200 until the leading end of the sheet reaches the reverse point 201, and accordingly, this embodiment is not applicable.

Flowchart

Figure 6:
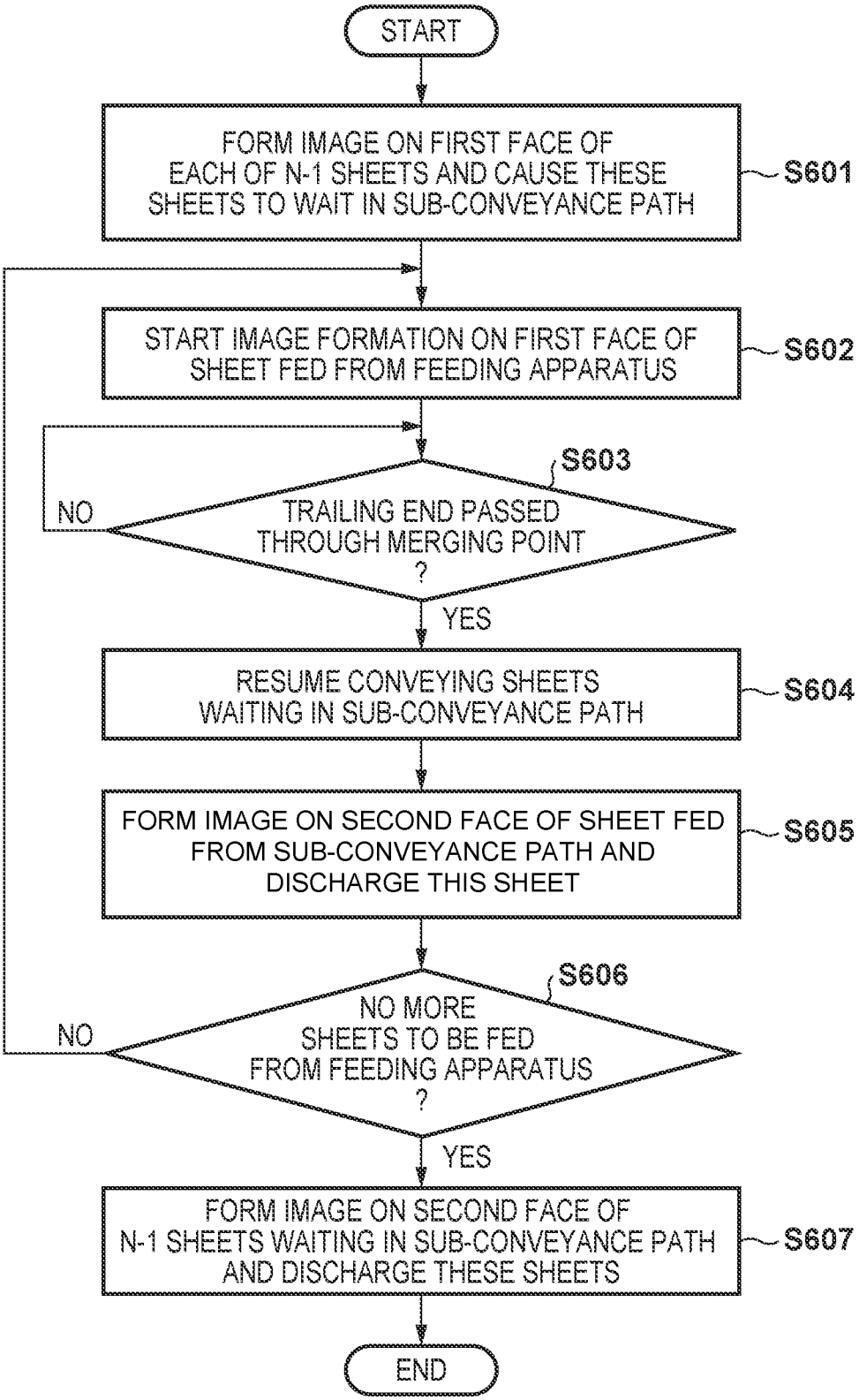
FIG. 6 is a flowchart depicting sheet conveyance control.

FIG. 6 is a flowchart depicting sheet conveyance control executed by the CPU 104 to perform duplex printing. It is assumed here that duplex printing is performed on M sheets. The image forming apparatus 100 can execute an N-sheet circulating mode (M and N are natural numbers, where M>N). The length of the sub-conveyance path r2 is a length on which a maximum of N−1 sheets can wait. The rearmost sheet waits while being nipped by the reverse roller pair 50. That is to say, the rearmost sheet waits while spanning the reverse roller pair 50 and the sub-conveyance path r2. The controller 102 receives a print instruction transmitted by the host computer 103. The controller 102 instructs the print control unit 101 to perform duplex printing in accordance with the print instruction.

In step S601, the CPU 104 controls the image forming unit 110, the motor driving unit 111, the flapper driving unit 112, and so on to form an image on the first face of each of the first to N−1th sheets, feeds the first to N−1th sheets to the sub-conveyance path r2, and causes these sheets to wait. If N=3, the CPU 104 causes the feeding apparatus 12 to feed the first sheet P1, and stops, upon the first sheet P1 reaching the registration roller pair 16, the registration roller pair 16 by stopping the motor M3. If the rotational speed of the registration roller pair 16 can be variably controlled, the stopping of the registration roller pair 16 is not essential. The CPU 104 resumes the rotation of the motor M3 synchronously with the image forming timing of the image forming unit 110, rotates the registration roller pair 16, conveys the sheet P1 to the secondary transfer unit 80, and transfers the toner images to the first face of the sheet P1. The CPU 104 controls the flapper 55 through the flapper driving unit 112, and guides the sheet P1 to the reverse roller pair 50. Note that the CPU 104 may start to rotate the reverse roller pair 50 in the reverse direction using the motor M1 when the leading end of the sheet P1 passes through the reverse point 201, and thus prepare for the arrival of the leading end of the sheet P1, for example. Also, the CPU 104, upon being instructed to feed the sheet P2 by the controller 102, instructs the feeding apparatus 12 to feed the sheet P2. Upon the trailing end of the sheet P1 passing through the reverse point 201, the CPU 104 starts to rotate the reverse roller pair 50 in the forward direction using the motor M1, and starts to rotate the conveyance roller pairs 51, 52, and 53 using the motor M2, thereby conveying the sheet P1 to the waiting position. Upon the sheet P2 reaching the registration roller pair 16, the CPU 104 stops the registration roller pair 16 by stopping the motor M3. The CPU 104 resumes rotating the motor M3 synchronously with the image formation timing of the image forming unit 110, rotates the registration roller pair 16, conveys the sheet P2 to the secondary transfer unit 80, and transfers the toner images on the first face of the sheet P2. The CPU 104 controls the flapper 55 through the flapper driving unit 112, and guides the sheet P2 to the reverse roller pair 50. Note that the CPU 104 starts to rotate the reverse roller pair 50 in the reverse direction using the motor M1 when the trailing end of the sheet P2 passes through the merging point 200, and thus prepares for the arrival of the leading end of the sheet P2. The CPU 104, upon being instructed to feed the sheet P3 by the controller 102, instructs the feeding apparatus 12 to feed the sheet P3.

In step S602, the CPU 104 starts image formation on the first faces of the sheets fed from the feeding apparatus 12. For example, if N−1 sheets are waiting in the sub-conveyance path r2, the CPU 104 controls the image forming unit 110, the motor driving unit 111, the flapper driving unit 112, and so on to start image formation on the first face of an $N^{th}$ sheet.

In step S603, the CPU 104 determines whether or not the trailing end of the sheet on which an image is being formed has passed through the merging point 200, based on the detection result from the sheet sensors. If the trailing end of the sheet on which an image is being formed has passed through the merging point 200, the CPU 104 proceeds to step S604. Note that the CPU 104 controls the flapper 55 and the reverse roller pair 50 to convey the sheet with an image formed on the first face, toward the reverse roller pair 50.

In step S604, the CPU 104 resumes conveying the sheets that are waiting in the sub-conveyance path r2. The CPU 104 starts the motor M1 through the motor driving unit 111 to rotate the reverse roller pair 50 in the forward direction, starts the motor M2 to rotate the conveyance roller pairs 51, 52, and 53, and resumes conveying the sheets that have been waiting in the sub-conveyance path r2. Thus, the sheet that is located at the head in the sub-conveyance path r2 is conveyed to the main conveyance path r1. Also, the trailing end of the sheet that has been waiting while being nipped by the reverse roller pair 50 moves downstream of the reverse point 201. Accordingly, even if the following sheet arrives at the reverse point 201, the following sheet does not collide with the leading sheet. Note that, upon the trailing end of the sheet that has been waiting while being nipped by the reverse roller pair 50 passing through the reverse point 201, the CPU 104 switches the rotation of the motor M1 from forward rotation to reverse rotation, and prepares for a sheet that will be fed from the main conveyance path r1. Also, upon the trailing end of a sheet that has been fed from the main conveyance path r1 and pulled into the reverse roller pair 50 passing through the reverse point 201, the CPU 104 switches the rotation of the motor M1 from reverse rotation to forward rotation, and feeds this sheet to the sub-conveyance path r2. As shown in FIG. 5C, upon the leading end of the sheet that has been located second from the head in the sub-conveyance path r2 arriving at the waiting position, the CPU 104 stops the motors M1 and M2.

In step S605, the CPU 104 forms an image on the second face of the sheet that has been fed from the sub-conveyance path r2 to the main conveyance path r1, and discharges this sheet. For example, the CPU 104 feeds the sheet to the secondary transfer unit 80 while synchronizing the sheet conveyance timing with the image formation timing using the registration roller pair 16. The CPU 104 switches the flapper 55, guides the sheet with an image formed on the second face to the discharge path r3, and discharges the sheet to the discharge tray 90.

In step S606, the CPU 104 determines whether or not there is any sheet to be newly fed from the feeding apparatus 12 to the main conveyance path r1. For example, if M sheets have already been fed, the CPU 104 determines that there are no more sheets to be fed (i.e. the print job is complete). If the number of sheets that have been fed from the feeding apparatus 12 has not reach M, the CPU 104 returns to step S602 and repeatedly executes the processing from step S602 to step S606. That is to say, upon the number of sheets waiting in the sub-conveyance path r2 reaching the upper limit number, namely N−1, image formation on the first face of a sheet that has been fed from the feeding apparatus and image formation on the second face of a sheet that has been fed from the sub-conveyance path r2 are alternately executed. If the number of sheets that have been fed from the feeding apparatus 12 has reached M, there are no more sheets to be newly fed from the feeding apparatus 12 to the main conveyance path r1, and accordingly, the CPU 104 proceeds to step S607.

In step S607, the CPU 104 forms an image on the second faces of the N−1 sheets that have been waiting in the sub-conveyance path r2, and discharges these sheets. For example, the CPU 104 feeds the sheets to the secondary transfer unit 80 while synchronizing the sheet conveyance timing with the image formation timing using the registration roller pair 16. The CPU 104 switches the flapper 55, guides the sheets with an image formed on the second faces to the discharge path r3, and discharges the sheets to the discharge tray 90. The CPU 104 controls the motors M1 and M2 to convey the N−1 sheets downstream of the sub-conveyance path r2. As shown in FIG. 3A and other diagrams, image formation on the second face of the last N−1 sheet of the M sheets is continuously executed. This is because no more sheets will be newly fed from the feeding apparatus 12.

Timing Chart

Figure 7:
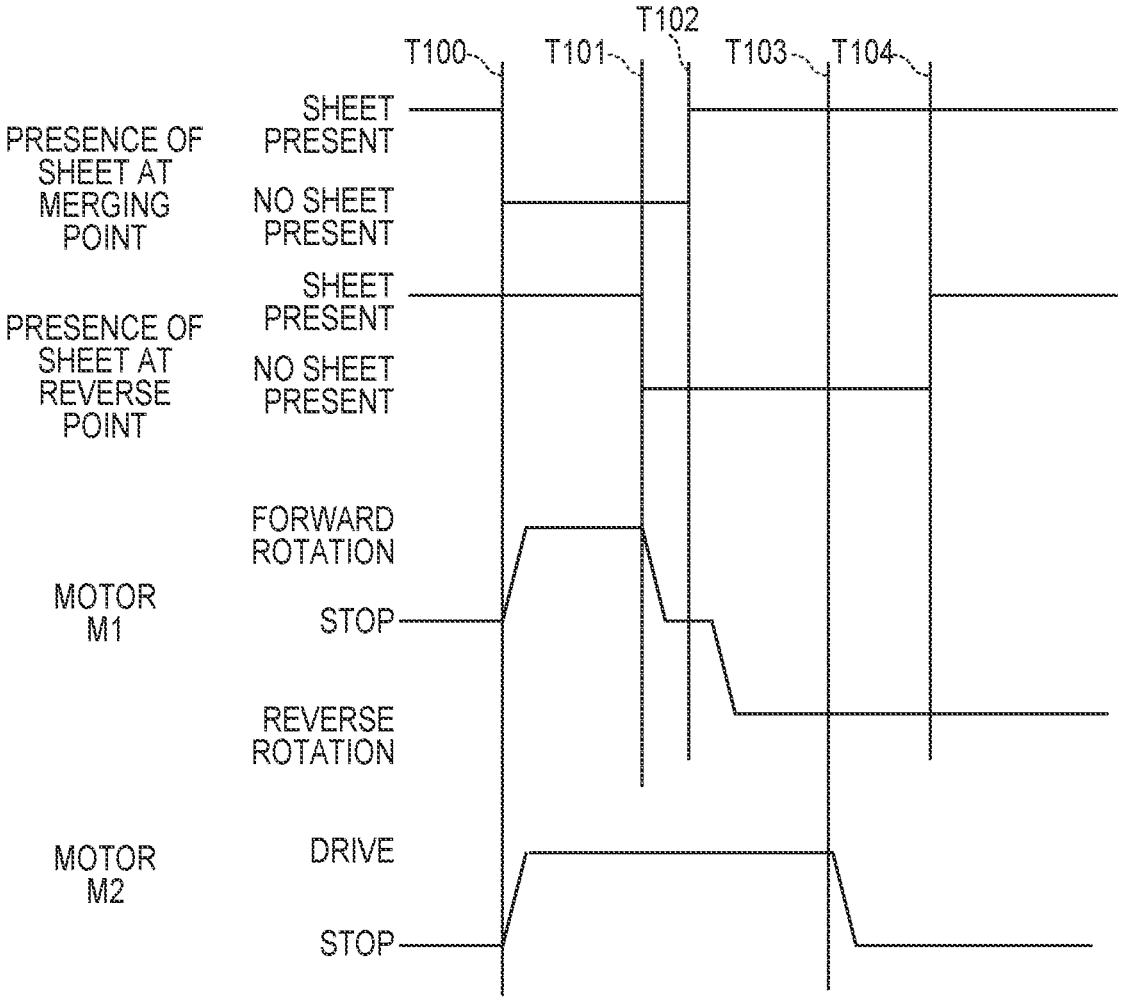
FIG. 7 is a timing chart depicting sheet conveyance control.

FIG. 7 is a timing chart depicting preceding feeding during duplex printing. It is assumed here that N=3.

T100: Upon the trailing end of the third sheet P3 passing through the merging point 200, the level of the detection signal output by the sheet sensor 62 switches to OFF (no sheet detected) (Yes in step S603). The CPU 104 starts to rotate the reverse roller pair 50 using the motor M1. The CPU 104 also rotates the motor M2 and starts to rotate the conveyance roller pairs 51, 52, and, 53. The sheets P1 and P2 then move downward along the sub-conveyance path r2.

T101: Upon the trailing end of the second sheet P2 passing through the reverse point 201, the level of the detection signal output by the sheet sensor 61 switches to OFF (no sheet detected). To pull the sheet P3 into the reverse roller pair 70, the CPU 104 rotates the motor M1 in the reverse direction to rotate the reverse roller pair 50 in the reverse direction.

T102: Upon the leading end of the sheet P1 reaching the merging point 200, the level of the detection signal output by the sheet sensor 62 switches to ON (sheet detected).

T103: Upon the leading end of the sheet P1 reaching the sheet sensor 63, which may also be called a registration sensor, the CPU 104 stops the motors M2 and M3. As a result, the registration roller pair 16 and the conveyance roller pairs 51, 52, and 53 also stop.

T104: Upon the leading end of the sheet P3 reaching the reverse point 201, the level of the detection signal output by the sheet sensor 61 switches to ON (sheet detected). Upon the level of the detection signal output by the sheet sensor 61 switching to OFF (no sheet detected) due to the trailing end of the sheet P3 passing the sheet sensor 61, the CPU 104 switches the rotation of the motor M1 from rearward rotation to forward rotation. Upon the leading end of the sheet P3 reaching a predetermined waiting position on the sub-conveyance path r2, the CPU 104 stops the motor M1.

Length of Sub-Conveyance Path

Figure 8A:
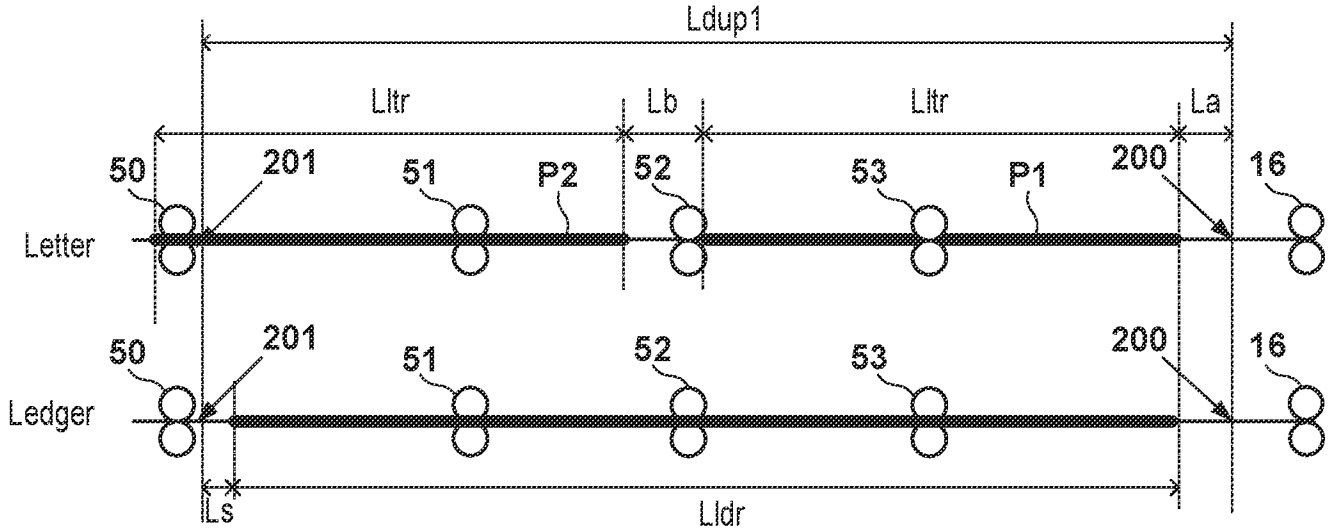
FIGS. 8A and 8B are diagrams showing the length of a sub-conveyance path.

FIG. 8A shows a waiting state of sheets in the sub-conveyance path r2. Here, Letter sheets and a Ledger sheet are shown as an example. The sheet length Ltr of a Letter sheet in the conveyance direction is 215.9 mm. The CPU 104 controls the motor M2 so that the leading end of a first sheet P1 stops at a position that is distant, on the upstream side, from the merging point 200 by a distance La. Note that, if the leading end of a sheet protrudes downward from the merging point 200, this sheet may collide with a third sheet P3 that is newly fed from the feeding apparatus 12. Giving consideration to a variation in conveyance or the like, the sheet P1 waits with its leading end stopping at the position that is distant, on the upstream side, from the merging point 200 by the distance La. La is determined based on the result of measurement of the variation in sheet conveyance, the simulation result, or the like. The distance between the trailing end of the leading sheet P1 and a following sheet P2 is Lb. Lb is determined while considering a variation in conveyance of the sheet P1, a variation in conveyance of the sheet P2, and a margin value of a sheet length that is allowable for the image forming apparatus 100.

The Ledger sheet is an example of a sheet having a maximum printable size for the image forming apparatus 100. The sheet length Lldr of a Ledger sheet in the conveyance direction is 431.8 mm. Since the sheet length of the Ledger sheet is too long, the three-sheet circulating mode is not applicable, and the two-sheet circulating mode is applied. In the two-sheet circulating mode, the Ledger sheet waits in a path from the merging point 200 to the reverse point 201. The CPU 104 stops the leading end of the Ledger sheet at a position that is distant, on the upstream side, from the merging point 200 by the distance La. This is the same idea as in the case of the Letter size. The distance from the trailing end of the Ledger sheet to the reverse point 201 is set to Ls, giving consideration to the variation in conveyance.

As is understood from FIG. 8A, the length of the sub-conveyance path r2 in the image forming apparatus 100 is restricted by the length of the Ledger sheet. The distance Ldup1 from the merging point 200 to the reverse point 201 is determined so as to satisfy the following equation.

$$Ldup1 = La + Lldr + Ls \quad (1)$$

Figure 8B:
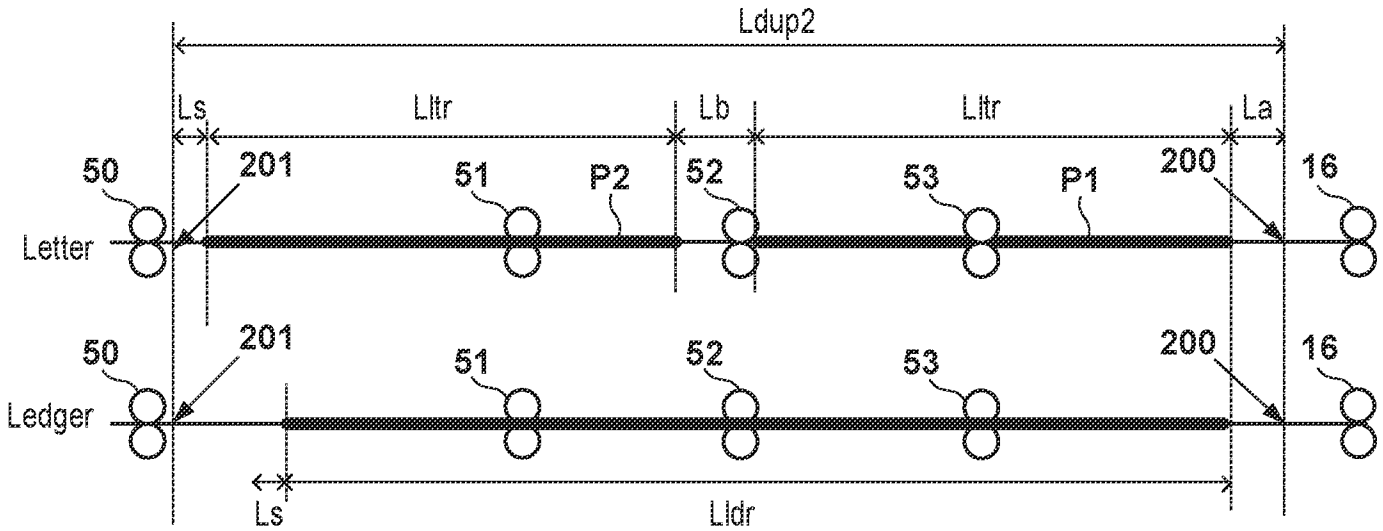

FIG. 8B shows a waiting state of sheets in the sub-conveyance path r2 in the comparative example. In the case of the Letter sheets, the trailing end of a second sheet P2 needs to be located downstream of the reverse point 201. This restriction determines the distance Ldup2 of the sub-conveyance path r2.

$$\begin{aligned} Ldup2 &= La + Lltr + Lb + Lltr + Ls \\ &= La + Lldr + Lb + Ls \end{aligned} \quad (2)$$

As is understood by comparing Equation (1) with Equation (2), the length of the sub-conveyance path r2 according to this embodiment is shorter than the length of the sub-conveyance path r2 in the comparative example by Lb.

This embodiment mainly takes an example in which the number of sheets to be circulated N is three, but N may also be four or more. According to this embodiment, the sub-conveyance path r2 is so short that a sheet with an image formed on the first face needs to wait while spanning the reverse roller pair 50 and the sub-conveyance path r2. For this reason, the waiting sheet needs to be moved downstream in the sub-conveyance path r2 so that this waiting sheet does not come into contact with a sheet that is fed in from the main conveyance path r1. That is to say, the CPU 104 executes conveyance control so that the trailing end of a sheet that is present at the reverse point 201 finishes passing through the reverse point 201 during a period of time from when the trailing end of a sheet that is being printed on the first face thereof passes through the merging point 200 until the leading end of this sheet reaches the reverse point 201. That is to say, this embodiment is applicable to an image forming apparatus in which the rearmost sheet waiting in the sub-conveyance path r2 may be located at least at the reverse point 201. A plurality of sheets may wait between the sheet at the head and the rearmost sheet that are waiting in the sub-conveyance path r2. Note that the sheet at the head and the rearmost sheet may be the same sheet. In this case, the two-sheet circulating mode shown in FIG. 3B is executed by the CPU 104. Accordingly, N need only be an integer that is 2 or greater.

In the first embodiment, the number of sheets to be circulated may be changed in accordance with the sheet length. For example, the CPU 104 may set the number of sheets to be circulated to three if the sheet length is equal to or shorter than a predetermined length, and may set the number of sheets to be circulated to two if the sheet length is longer than the predetermined length. The predetermined length to serve as a threshold value may be set in accordance with the length of the conveyance path.

Also, the first embodiment may employ a configuration in which the conveyance roller pairs 51 and 52 are omitted, and sheets are directly conveyed from the reverse roller pair 50 to the conveyance roller pair 53.

Second Embodiment

The second embodiment is an example in which the length of the sub-conveyance path r2 is determined by also considering factors other than control.

In the second embodiment, items shared with the first embodiment are assigned the same reference signs, and descriptions thereof will be omitted.

Various kinds of sheets are commercially available. For example, not only thick paper and coated paper (gloss paper)

that have a larger basis weight, but also normal paper, thin paper, and the like that have a relatively small basis weight are widely used. Here, it is to be noticed that the basis weight of sheets affects conveyance control. Typically, the basis weight of sheets is inversely proportional to sheet conveyance efficiency. For example, conveyance efficiency in the case of thick paper and gloss paper is lower than conveyance efficiency in the case of plain paper and thin paper. For this reason, a conveyance delay is likely to occur in the case of thick paper and gloss paper. Such sheets with low conveyance efficiency may stop upstream of a target position. This may cause a leading sheet and a following sheet to come into contact with each other at the reverse point 201. The second embodiment proposes conveyance control in which consideration is given to the sheet type (a parameter that may affect conveyance efficiency, such as the basis weight).

Figure 9:
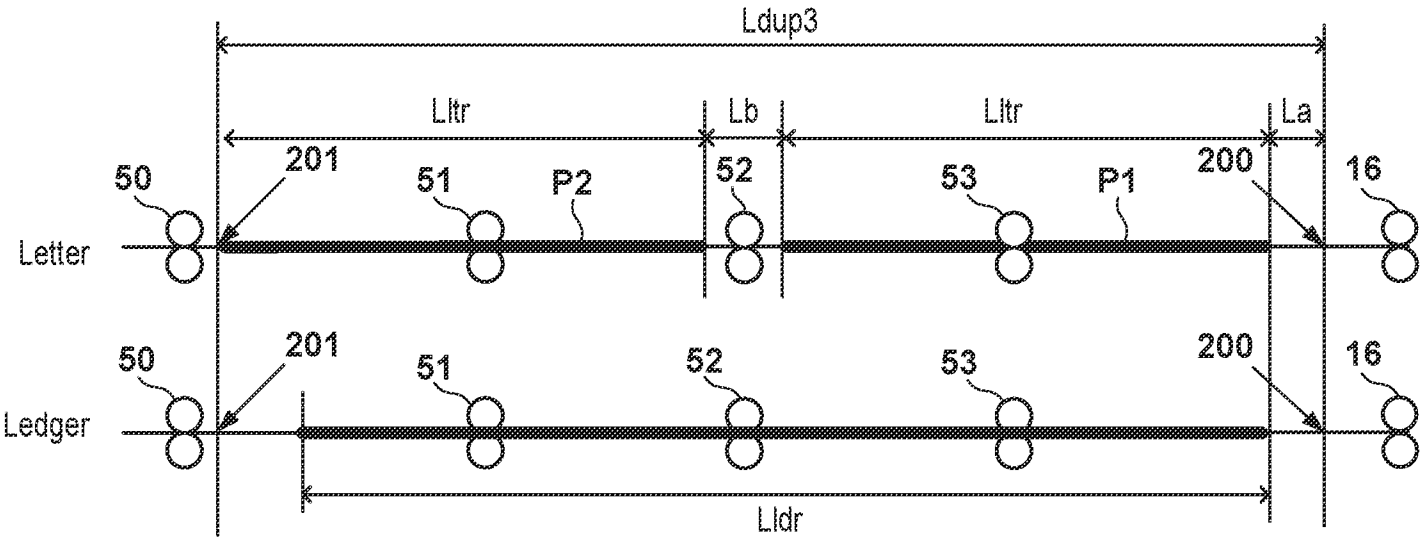
FIG. 9 is a diagram showing the length of the sub-conveyance path.

FIG. 9 is a diagram illustrating the distance Ldup3 of the sub-conveyance path r2 in the second embodiment. Here, a relationship in which Ldup2>Ldup3>Ldup1 holds. The distance Ldup3 of the sub-conveyance path r2 in the second embodiment is shorter than the distance Ldup2 of the sub-conveyance path r2 in the comparative example, but is longer than the distance Ldup1 of the sub-conveyance path r2 in the first embodiment. As shown in FIG. 9, the distance Ldup3 is the distance from the merging point 200 to the reverse point 201, and the trailing end of the rearmost sheet waiting in the sub-conveyance path r2 is located at the reverse point 201. Accordingly, plain paper and thin paper will not completely obstruct the reverse point 201. On the other hand, in the case of thick paper or the like, a sheet may wait with the trailing end thereof stopping downstream of the reverse roller pair 50 and upstream of the reverse point 201, and accordingly may obstruct the reverse point 201. That is to say, if a sheet of plain paper or thin paper is the rearmost sheet, a following sheet can be conveyed to the reverse unit 70 as in the comparative example, but if a sheet of thick paper or the like is the rearmost sheet, the following sheet cannot be conveyed to the reverse unit 70. Accordingly, preceding feeding of waiting sheets described in the first embodiment is necessary for thick paper or the like.

Flowchart

Figure 10:
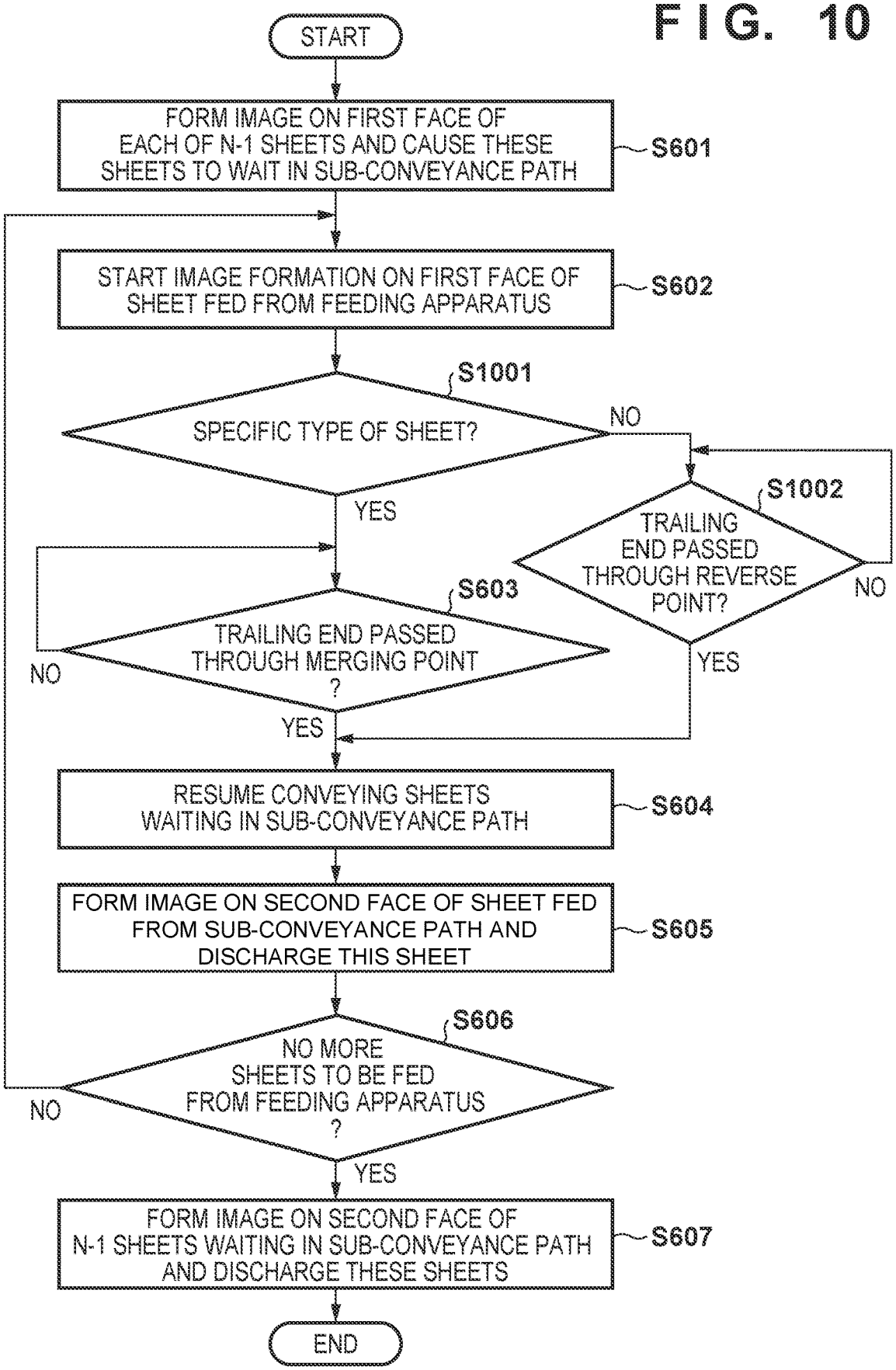
FIG. 10 is a flowchart depicting sheet conveyance control.

FIG. 10 is a flowchart showing the sheet conveyance control according to the second embodiment. Note that, in the second embodiment, items shared with the first embodiment are assigned the same reference signs. In step S601, image formation on the first to N−1$^{th}$ sheets is completed, and these sheets wait in the sub-conveyance path r2. In step S602, the CPU 104 causes the feeding apparatus 12 to feed the next sheet (e.g. N$^{th}$ sheet), and starts to form an image on the first face of the next sheet.

In step S1001, the CPU 104 determines whether or not the type of sheet is a specific type (thick paper, gloss paper etc.). Here, the sheet basis weight may be compared with a threshold value, or the sheet conveyance efficiency may be compared with a threshold value. Information indicating the type of sheet is provided from the host computer 103, for example. If the type of sheet is a specific type, the CPU 104 proceeds to step S603 to execute preceding feeding of the sheet at the head that is waiting in the sub-conveyance path r2. Accordingly, the CPU 104 prohibits feeding of sheets from the feeding apparatus 12 while feeding the sheet at the head that has been waiting in the sub-conveyance path r2 to the main conveyance path r1. Thereafter, the CPU 104 executes processing in step S604 and the subsequent steps. That is to say, in the case of thick paper or the like, the same processing as in the first embodiment is applied. On the other hand, if it is determined that the type of the next sheet is a specific type, the CPU 104 proceeds to step S1002. Note that, if all M sheets that constitute one print job are of the same type, the type designated by the print job is to be determined. However, it is sufficient if at least the type of the rearmost sheet in the sub-conveyance path r2 is determined. This is because the rearmost sheet may obstruct the reverse point 201.

In step S1002, the CPU 104 determines whether or not a sheet (e.g. N$^{th}$ sheet) with an image formed on the first face has been pulled into the reverse unit 70 by the reverse roller pair 50, and the trailing end of this sheet has passed through the reverse point 201. If the trailing end of the sheet has passed through the reverse point 201, the CPU 104 proceeds to step S604. In step S604, the CPU 104 resumes conveying N−1 sheets that have been waiting in the sub-conveyance path r2.

Thus, the timing and trigger of resuming conveying the sheets waiting in the sub-conveyance path r2 are different between sheets with high conveyance efficiency and sheets with low conveyance efficiency. For example, if a sheet of plain paper, thin paper, or the like is the rearmost sheet in the sub-conveyance path r2, preceding feeding according to the first embodiment is not executed. Accordingly, further feeding of the next sheet (N+1$^{th}$ sheet) from the feeding apparatus 12 is not prohibited, and image formation on this sheet is not prohibited either. This is because it is possible to cause N sheets to wait in a waiting path formed by the sub-conveyance path r2 and the reverse unit 70, while forming an image on another sheet and discharge this sheet to the discharge tray 90.

Thus, if the type of a sheet, from among the sheets waiting in the sub-conveyance path r2, whose trailing end position is closest to the reverse point is a specific type with low conveyance efficiency, the CPU 104 performs preceding feeding of the sheet at the head in the sub-conveyance path r2. Thus, a following sheet is less likely to come into contact, at the reverse point 201, with the leading sheet. On the other hand, if the type of a sheet whose trailing end position is closest to the reverse point among the sheets waiting in the sub-conveyance path r2 is a type whose conveyance efficiency is not low, the CPU 104 does not execute preceding feeding. That is to say, the CPU 104 feeds a following sheet to the reverse unit 70 while making N−1 sheets wait in the sub-conveyance path r2. In this case, the trailing end of a sheet that is waiting near the reverse point is located downstream of the reverse point, and accordingly, sheets are unlikely to come into contact with each other.

Figure 11:
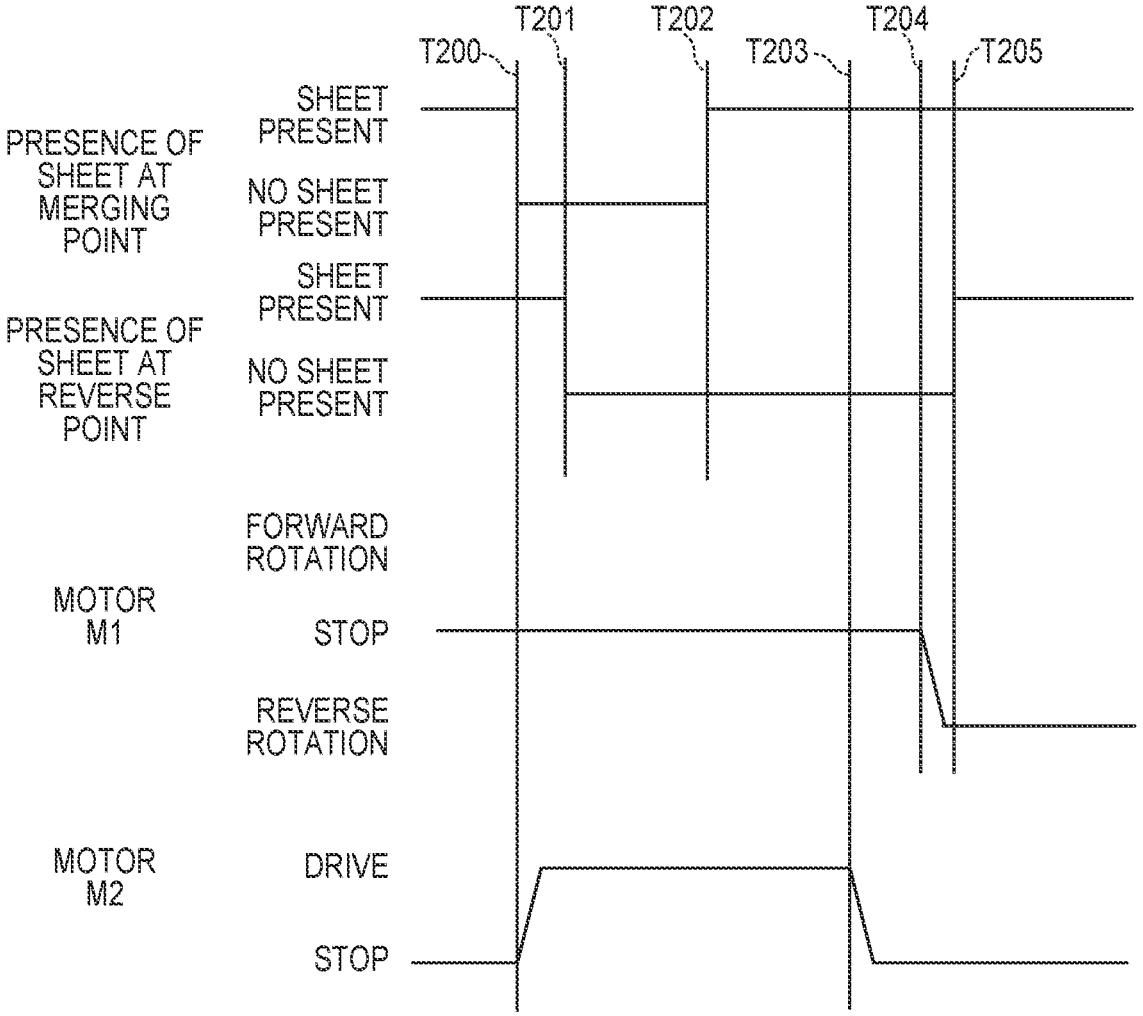
FIG. 11 is a timing chart depicting sheet conveyance control.

FIG. 11 is a timing chart depicting conveyance control for sheets with small conveyance efficiency (i.e. with a large basis weight), such as thick paper or gloss paper. It is here assumed that N=3.

T200: Upon the trailing end of the third sheet P3 passing through the merging point 200, the motor M2 is started and drives the conveyance roller pairs 51, 52, and 53. Note that, in this embodiment, the trailing end of the second sheet P2 is located downstream of the reverse roller pair 50, as shown in FIG. 9. Accordingly, the CPU 104 does not need to rotate the motor M1 for driving the reverse roller pair 50.

T201: Due to the sheet P2 being conveyed downstream by the conveyance roller pairs 51, 52, and 53, the trailing end of the sheet P2 passes through the reverse point 201.

T202: Due to the sheet P1 that has been waiting at the head in the sub-conveyance path r2 being conveyed downstream by the conveyance roller pairs 51, 52, and 53, the leading end of the sheet P1 reaches the merging point 200.

T203: Upon the leading end of the sheet P1 reaching the sheet sensor 63 (registration sensor), the CPU 104 stops the motor M3 that drives the registration roller pair 16, and the motor M2 that drives the conveyance roller pairs 51, 52, and 53.

T204: The CPU 104 starts to rotate the motor M1 in the reverse direction before the leading end of the sheet P3 reaches the reverse point 201. Thus, preparations to receive the sheet P3 are complete.

T205: The leading end of the sheet P3 reaches the reverse point 201.

As described above, in the second embodiment, whether to execute preceding feeding is switched in accordance with the sheet type.

As a result, sheets are less likely to come into contact with each other, whereas the length of the sub-conveyance path r2 is made shorter than in the comparative example.

Third Embodiment

To match the timing at which the toner images reach the secondary transfer unit 80 with the timing at which the leading end of a sheet reaches the secondary transfer unit 80, the CPU 104 may variably control the rotational speed of the registration roller pair 16. For example, if a sheet that has been fed from the feeding apparatus 12 comes after a predetermined timing, the sheet conveyance speed is temporarily increased. If a sheet that has been fed from the feeding apparatus 12 comes earlier than the predetermined timing, the sheet conveyance speed is temporarily reduced. However, the CPU 104 restores the sheet conveyance speed to the conveyance speed of the intermediate transfer belt 8 until immediately before the leading end of the sheet reaches the secondary transfer unit 80.

Meanwhile, to reduce the number of motors, it is conceivable to drive the conveyance roller pair 53 and the registration roller pair 16 using the same motor. In this case, if the rotational speed of the registration roller pair 16 changes, the rotational speed of the conveyance roller pair 53 also changes. If a sheet that is being conveyed along the sub-conveyance path r2 is nipped near the leading end thereof by the conveyance roller pair 53, and is nipped near the center or the trailing end thereof by a conveyance roller pair that is driven by a different motor, the sheet may be pulled toward different sides or folded. To avoid this, it is conceivable to cause the leading end of a sheet that is being conveyed along the sub-conveyance path r2 to wait in front of the conveyance roller pair 53 until speed adjustment for the registration roller pair 16 is completed. That is to say, the sheet needs to wait at a waiting position that is upstream of the waiting position in the first embodiment. If the trailing end of a sheet that is waiting in the sub-conveyance path r2 obstructs the reverse point 201, a sheet with an image formed on the first face cannot be conveyed to the reverse roller pair 50. To resolve this, a method of avoiding contact between sheets by extending the sub-conveyance path r2 is conceivable, but this may make it difficult to reduce the size of the image forming apparatus 100.

The third embodiment provides an image forming apparatus 100 in which the length of the sub-conveyance path can be shortened while reducing the number of motors. In particular, in this embodiment, a sheet waits in the sub-conveyance path r2 in front of the conveyance roller pair 53 while the registration roller pair 16 is performing speed adjustment. With this configuration, a sheet is less likely to be pulled toward different sides, for example. Sheet conveyance is resumed in the sub-conveyance path r2 upon the registration roller pair 16 completing speed adjustment, and the conveyance roller pair 53 is stopped by a clutch upon the leading end of the sheet arriving at a waiting position forward of the merging point 200. Thus, the trailing end of the sheet that is being conveyed along the sub-conveyance path r2 can be positioned downstream of the reverse point 201. Also, in the main conveyance path r1, sheet conveyance by the registration roller pair 16 can be continued. This configuration makes it possible to shorten the sub-conveyance path r2.

Description of Configuration in Third Embodiment

Figure 12:
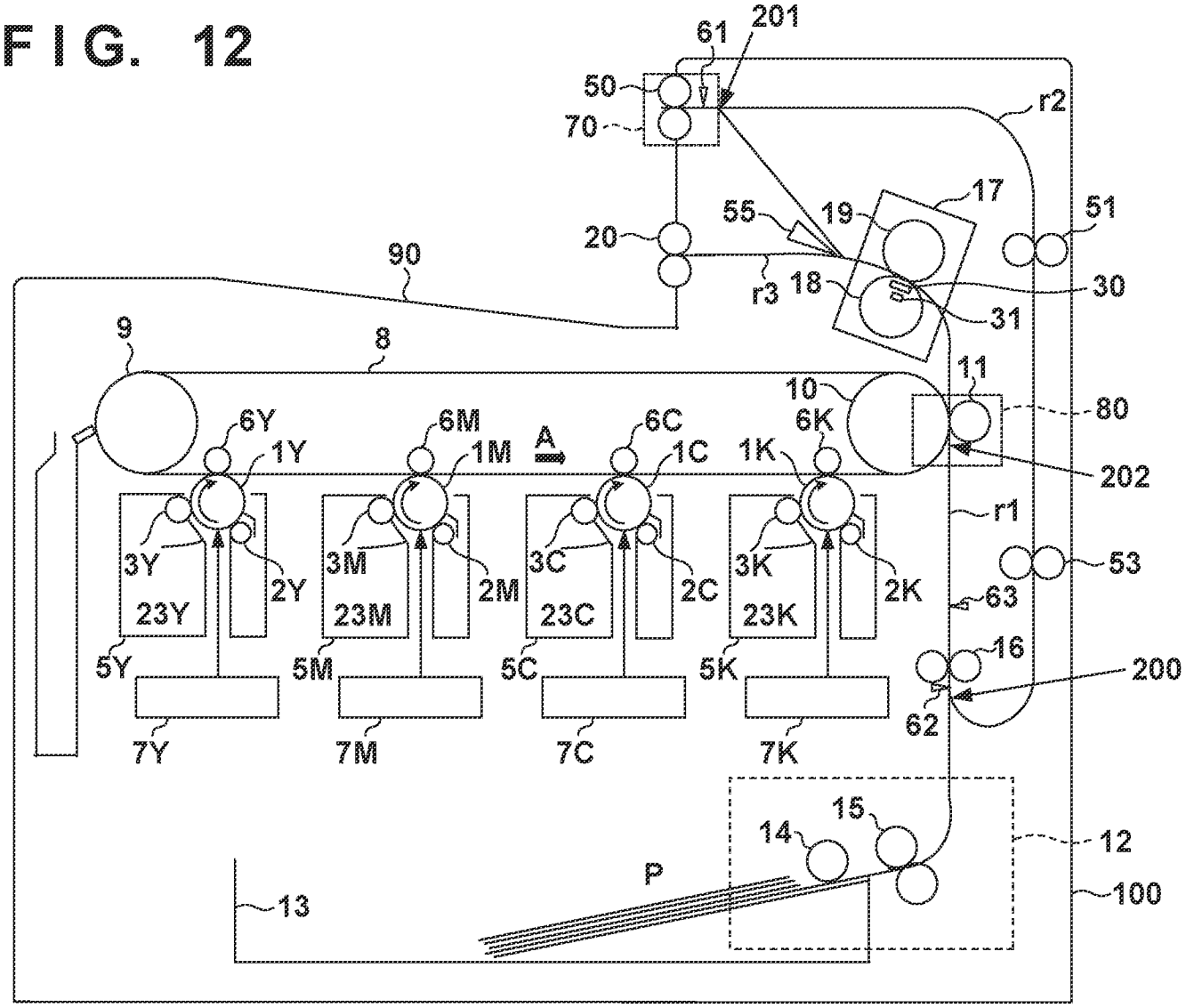
FIG. 12 is a schematic cross-sectional view of an image forming apparatus.

FIG. 12 shows the image forming apparatus 100 according to the third embodiment. The third embodiment is an image forming apparatus 100 that executes duplex printing using the two-sheet circulating mode, and accordingly, the length of the sub-conveyance path is shorter than that in the first embodiment. For this reason, the conveyance roller pair 51 and the conveyance roller pair 53 are provided in the sub-conveyance path r2, and the conveyance roller pair 52 is omitted.

Figure 13:
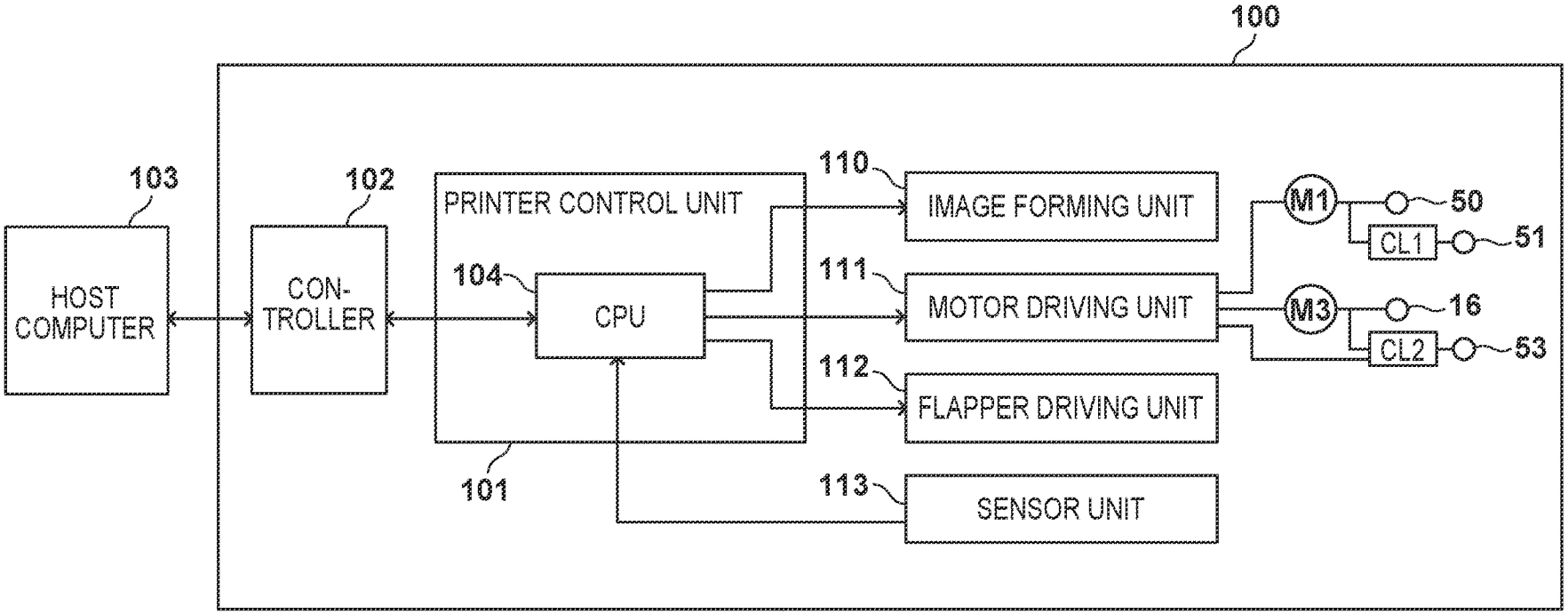
FIG. 13 is a block diagram showing a control system.

FIG. 13 shows a control system. The motor M1 drives the reverse roller pair 50 and the conveyance roller pair 51 that is arranged most upstream in the sub-conveyance path r2. A clutch CL1 is a one-way clutch. While the motor M1 is rotating in the forward direction, the clutch CL1 transmits the driving force of the motor M1 to the conveyance roller pair 51, and the conveyance roller pair 51 rotates. On the other hand, while the motor M1 is rotating in the reverse direction, the clutch CL1 does not transmit the driving force of the motor M1 to the conveyance roller pair 51. Note that the reverse roller pair 50 rotates in the forward and reverse directions in conjunction with the forward and reverse rotations of the motor M1. The motor M3 drives the registration roller pair 16 and the conveyance roller pair 53 that is arranged most downstream in the sub-conveyance path r2. A clutch CL2 is an electromagnetic clutch, which is controlled by the CPU 104 via the motor driving unit 111, for example. That is to say, the CPU 104 can stop the conveyance roller pair 53 by controlling the clutch CL2 even while the registration roller pair 16 is rotating.

Sheet Conveyance Control During Duplex Printing

FIGS. 14A to 14F are diagrams illustrating the two-sheet circulating mode with Letter/A4-size sheets.

Figure 14A:
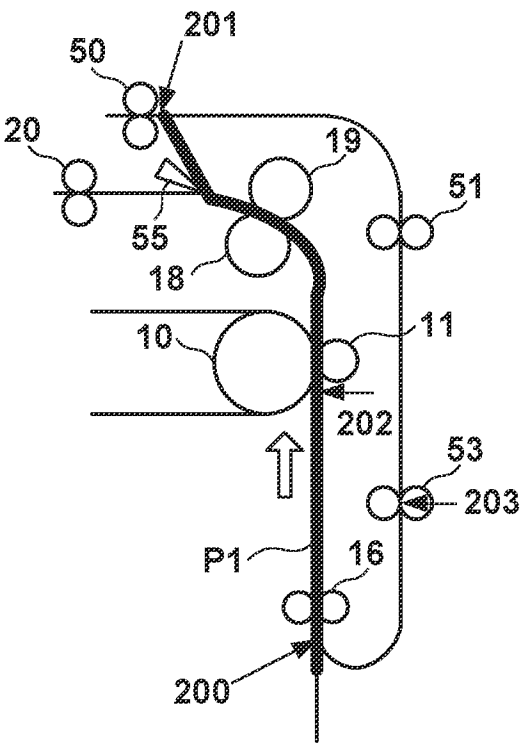
FIGS. 14A to 14F are diagrams illustrating sheet conveyance control.

1. As shown in FIG. 14A, the CPU 104 conveys a first sheet P1 with an image formed on the first face to the reverse point 201.

Figure 14B:
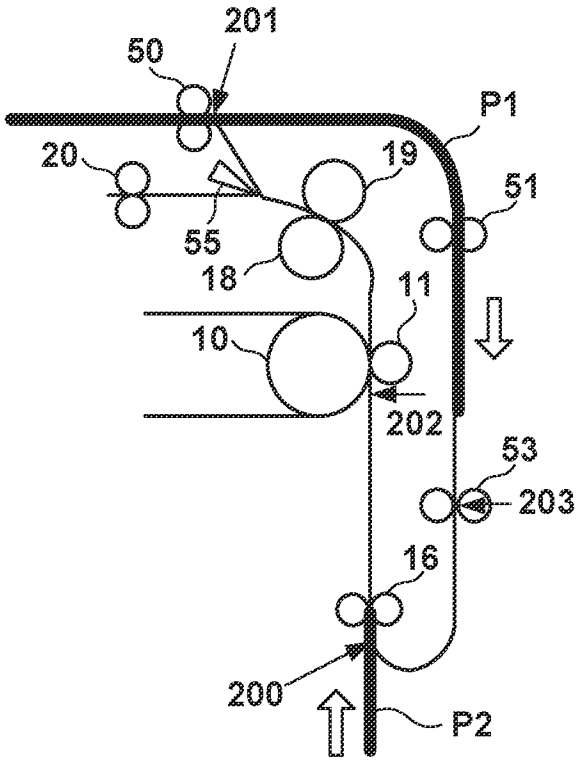

2. As shown in FIG. 14B, the CPU 104 conveys the sheet P1 along the sub-conveyance path r2 toward a competing point 203. On the other hand, to adjust the timing at which a second sheet P2 fed from the feeding apparatus 12 arrives at the secondary transfer unit 80, the CPU 104 starts to adjust the rotational speed of the registration roller pair 16.

Figure 14C:
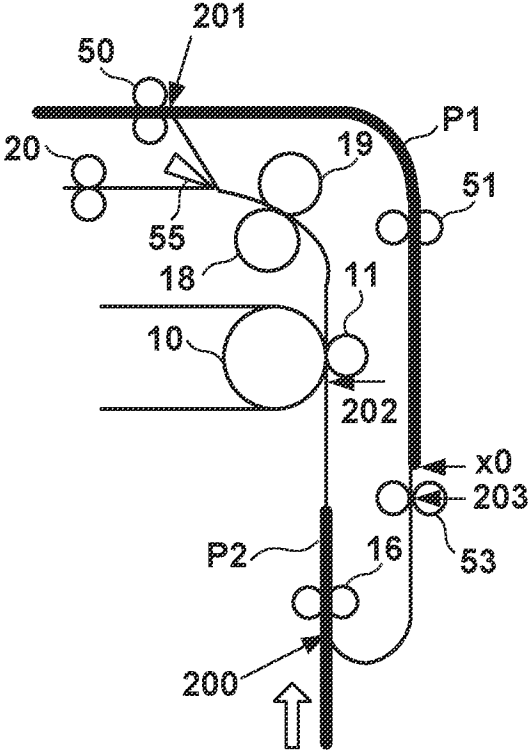

3. As shown in FIG. 14C, the CPU 104 controls the motor M1 so that the sheet P1 waits at a first waiting position x0, which is located in front of the competing point 203. The CPU 104 rotates the motor M2, and conveys a sheet P2 toward the secondary transfer unit 80 while executing speed adjustment using the registration roller pair 16. Since the sheet P1 is waiting upstream of the competing point 203, the sheet P1 is not affected by a difference between the conveyance speed of the conveyance roller pair 53 and the conveyance speed of the conveyance roller pair 51 and the reverse roller pair 50.

Figure 14D:
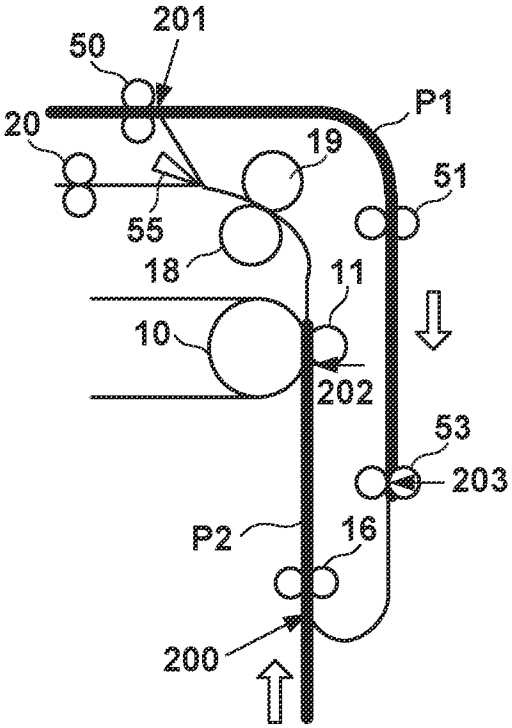

4. As shown in FIG. 14D, upon the sheet P2 reaching a stable-speed point 202, the CPU 104 controls the motor M1 so that the conveyance speed of the registration roller pair 16 is substantially the same as the conveyance speed of the image forming unit. The CPU 104 also resumes conveying the sheet P1 by switching on the clutch CL2 to transmit the driving force of the motor M3 to the conveyance roller pair 53. At this time, the CPU 104 may start the motor M1 to rotate the conveyance roller pair 51.

Figure 14E:
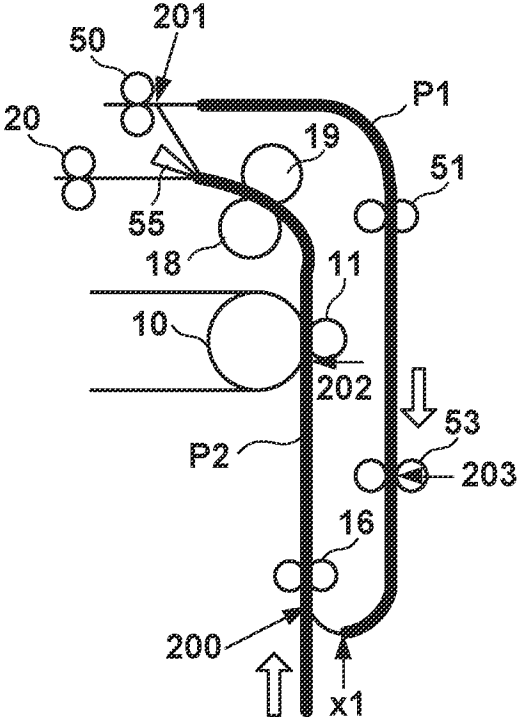

5. As shown in FIG. 14E, the CPU 104 switches off the clutch CL2 so that the leading end of the sheet P1 stops at a second waiting position x1. Thus, the conveyance roller pair 53 can be stopped while the registration roller pair 16 conveys the sheet P2. The length of the sub-conveyance path is designed so that, at this point, the trailing end of the sheet P1 exits the reverse point 201. Accordingly, the CPU 104 may switch the rotation of the motor M1 from forward rotation to reverse rotation simultaneously with the leading end of the sheet P1 stopping at the second waiting position x1, and thus prepare for conveyance of the sheet P2.

Figure 14F:
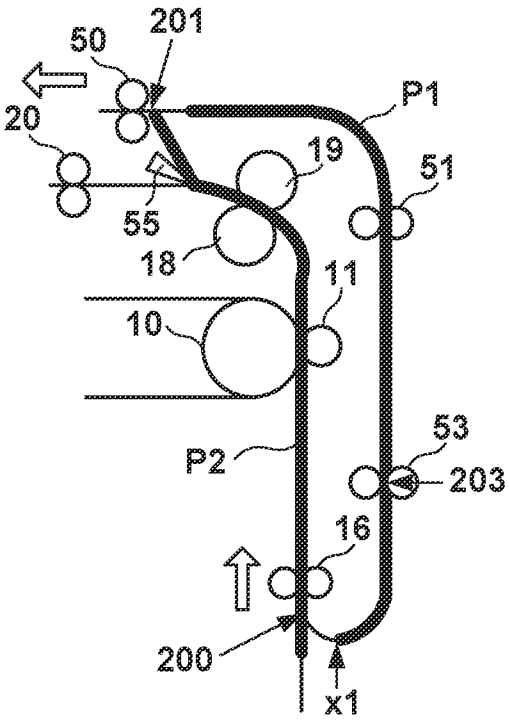

6. As shown in FIG. 14F, the CPU 104 controls the flapper 55 and conveys the second sheet P2 toward the reverse point 201. Since the trailing end of the sheet P1 has exited the reverse point 201 at this point, the sheet P2 will not come into contact with the sheet P1.

By employing this conveyance control, the distance from the reverse point 201 to the first waiting position x0 can be made shorter than the length of the sheet.

Figure 15:
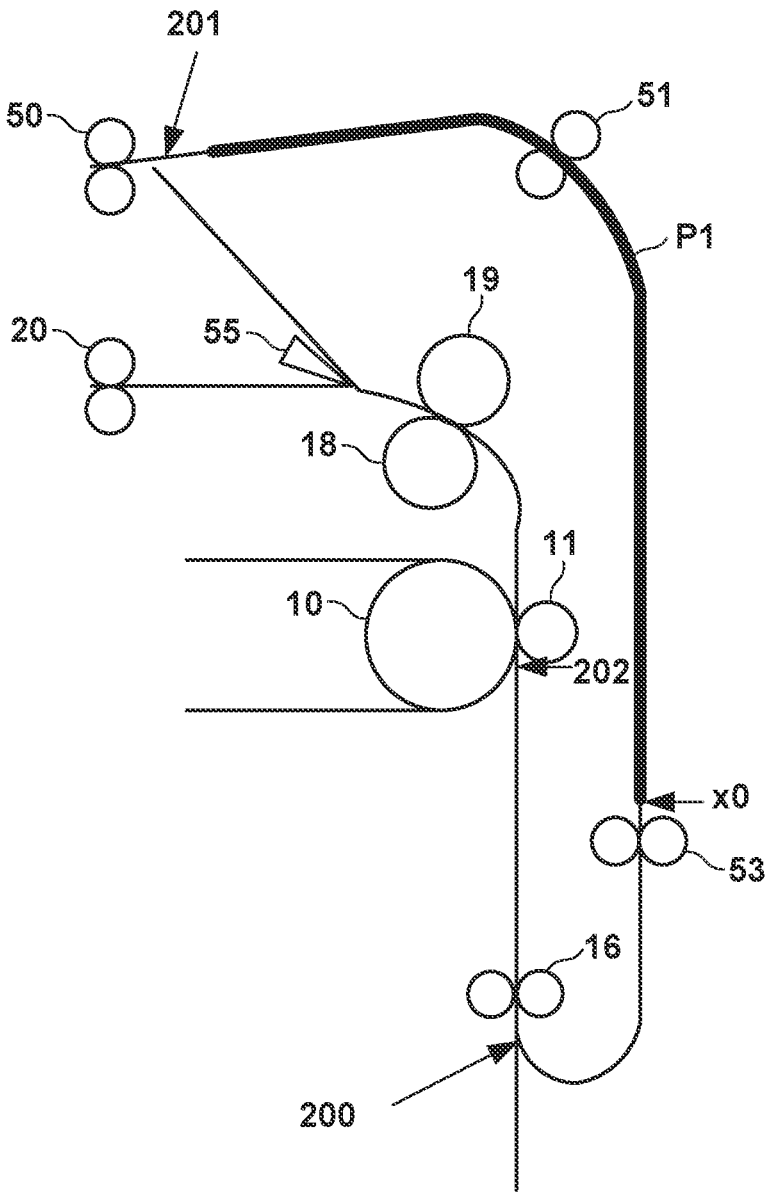
FIG. 15 is a diagram illustrating sheet conveyance control.

FIG. 15 shows the sub-conveyance path r2 in a comparative example. The clutch CL2 is not provided in this comparative example, and accordingly, the sheet P1 always needs to stop and wait at the first waiting position x0. Moreover, to avoid contact with the sheet P2, the distance from the first waiting position x0 to the reverse point 201 needs to be longer than the length of the sheet P1. In contrast, the third embodiment, in which the distance from the first waiting position x0 to the reverse point 201 can be made shorter than the length of the sheet, is more advantageous than the comparative example.

In particular, during a period from when the leading end of the sheet P2 has passed through the stable-speed point 202 until the leading end of the sheet P2 reaches the reverse point 201, the CPU 104 starts to move the sheet P1 that is present at the reverse point 201 to move the trailing end of the sheet P1 downstream of the reverse point 201.

Figure 16:
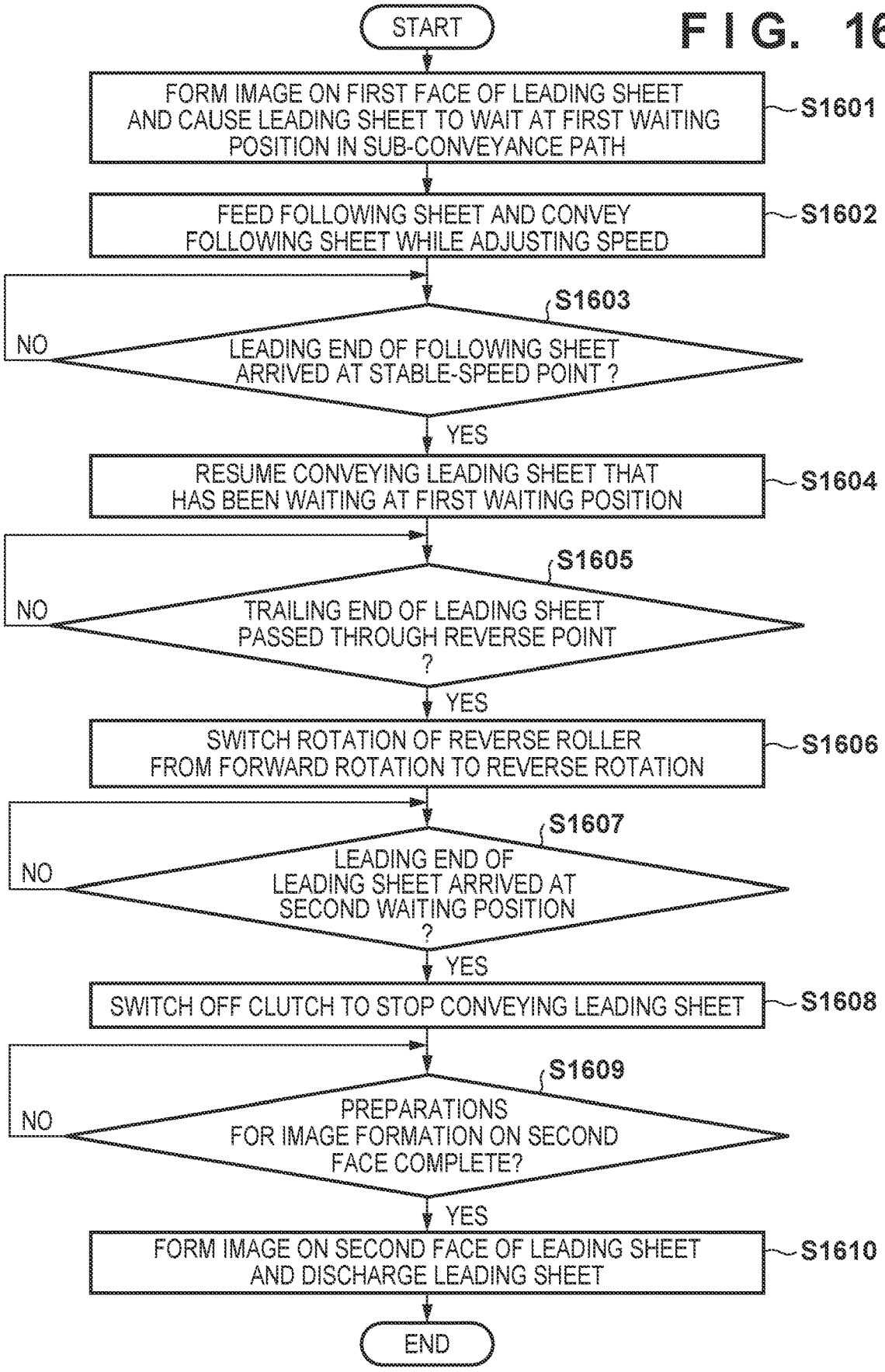
FIG. 16 is a flowchart depicting sheet conveyance control.

FIG. 16 is a flowchart depicting sheet conveyance control during duplex printing.

In step S1601, the CPU 104 controls the image forming unit 110, the motor driving unit 111, the flapper driving unit 112, and so on to form an image on the first face of a leading sheet (first sheet P1), feeds the leading sheet to the sub-conveyance path r2, and causes the leading sheet to wait at the first waiting position x0. The amount of time required from when the leading end of the leading sheet is detected by the sheet sensor 61 until the leading end of the leading sheet arrives at the first waiting position x0 takes a substantially fixed value (prescribed value). Accordingly, the CPU 104 starts a timer when the leading end of the leading sheet is detected by the sheet sensor 61, and stops the motor M1 upon the time counted by the timer reaching the prescribed value. Thus, as shown in FIG. 14C, the leading end of the leading sheet stops at the first waiting position x0.

In step S1602, the CPU 104 feeds a following sheet from the feeding apparatus 12, and conveys the following sheet while executing speed adjustment. As shown in FIG. 14B, the timing of feeding the following sheet may be prior to the timing at which the leading sheet arrives at the first waiting position x0. For example, the CPU 104 adjusts the conveyance speed of the registration roller pair 16 in accordance with whether or not the timing at which the leading end of the following sheet arrived at the sheet sensor 62 is later than a prescribed timing (reference timing). This speed adjustment is executed as a result of the CPU 104 adjusting the rotational speed of the motor M3.

In step S1603, the CPU 104 determines whether or not the leading end of the following sheet has arrived at the stable-speed point 202. For example, the CPU 104 calculates a distance based on the count value of the timer that was started when the sheet sensor 63 detected the leading end of the following sheet, and the conveyance speed, and determines whether or not the calculated distance is a distance that corresponds to the stable-speed point 202. If the leading end of the following sheet has arrived at the stable-speed point 202, the CPU 104 proceeds to step S1604. At this point, the CPU 104 completes the speed adjustment using the motor M3, and the conveyance speed coincides with the image forming speed (circumferential speed of the intermediate transfer belt).

In step S1604, the CPU 104 resumes conveying the leading sheet that has been waiting at the first waiting position x0. The CPU 104 starts to rotate the motor M1 in the forward direction, and also switches on the clutch CL2. As a result, the reverse roller pair 50 and the conveyance roller pairs 51 and 53 convey the leading sheet downstream of the sub-conveyance path r2 at the same conveyance speed.

In step S1605, the CPU 104 determines whether or not the trailing end of the leading sheet has passed through the reverse point 201. For example, the CPU 104 may determine that the trailing end of the leading sheet has passed through the reverse point 201 if the sheet sensor 61 detects that the trailing end of the leading sheet has passed. Also, the CPU 104 may determine that the trailing end of the leading sheet has passed through the reverse point 201 if a predetermined time has elapsed from the time when the trailing end of the leading sheet passed the sheet sensor 61. The predetermined time is a time obtained by dividing the distance between the sheet sensor 61 and the reverse point 201 by the conveyance speed. If the trailing end of the leading sheet has passed through the reverse point 201, the CPU 104 proceeds to step S1606.

In step S1606, the CPU 104 switches the rotation of the motor M1 from forward rotation to rearward rotation, thereby switching the rotation of the reverse roller pair 50 from forward rotation to rearward rotation. Thus, preparations for receiving the following sheet at the reverse unit 70 are complete.

In step S1607, the CPU 104 determines whether or not the leading end of the leading sheet has arrived at the second waiting position x1. The CPU 104 causes the timer to count the time that has elapsed since conveyance of the leading sheet was resumed, and determines that the leading end of the leading sheet has arrived at the second waiting position x1 if the elapsed time reaches a predetermined time. The predetermined time is obtained by dividing the distance between the first waiting position x0 to the second waiting position x1 by the conveyance speed. Note that the conveyance roller pair 53 may rotate even after the clutch CL2 has been turned off, due to inertia. Accordingly, the predetermined time may be made shorter by subtracting a margin. If the leading end of the leading sheet has arrived at the second waiting position x1, the CPU 104 proceeds to step S1608.

In step S1608, the CPU 104 switches off the clutch CL2 and stops conveyance of the leading sheet. Thus, the leading end of the leading sheet stops at the second waiting position x1. The motor M3 is continuously rotating at this point, and accordingly, the registration roller pair 16 also continuously conveys following sheets. That is to say, the steps from step S1601 are also sequentially applied to the following sheet, similar to the leading sheet.

In step S1609, if preparations for image formation on the second face of the leading sheet are complete, the CPU 104 proceeds to step S1610. In step S1610, the CPU 104 feeds the leading sheet to the main conveyance path r1, forms an image on the second face, and discharges the leading sheet via the discharge path r3. For example, upon the leading end of the second face of the leading sheet arriving at the stable-speed point 202, the CPU 104 switches the flapper 55 and discharges the leading sheet with images on both faces to the discharge tray 90. After the discharging of the leading sheet is complete, the CPU 104 restores the flapper 55 to an original state thereof for a third sheet to be fed from the feeding apparatus 12. Thereafter, the third sheet serves as a following sheet, an image is formed on the first face thereof, and the third sheet is fed to the sub-conveyance path r2. Then, the second sheet fed from the sub-conveyance path r2 serves as a leading sheet, an image is formed on the second face thereof, and the second sheet is discharged.

Figure 17:
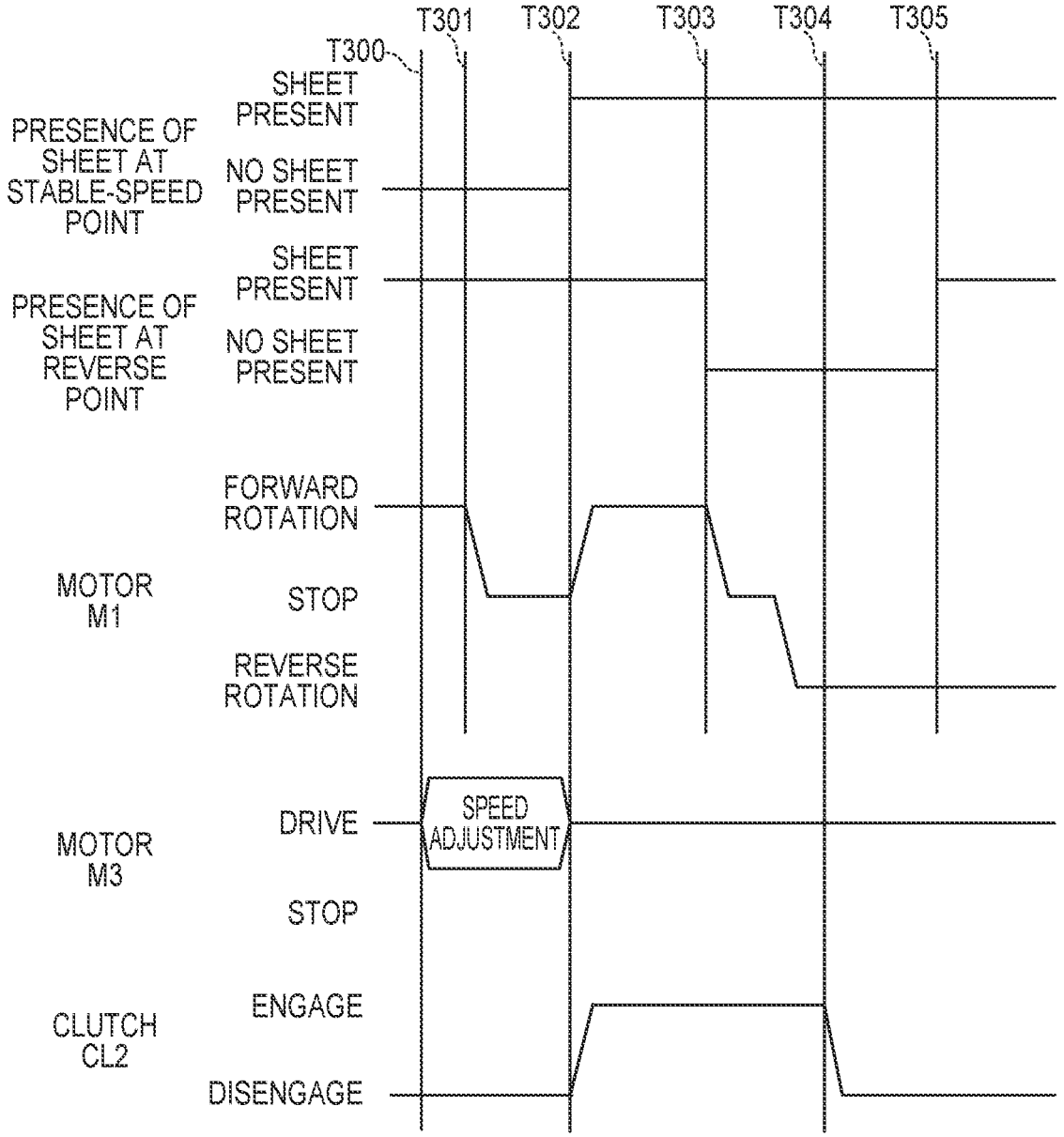
FIG. 17 is a timing chart depicting sheet conveyance control.

FIG. 17 is a timing chart depicting the two-sheet circulating mode.

T300: As described in step S1602, to synchronize the timing at which the following sheet arrives at the secondary transfer unit 80 with the timing at which the toner images arrive at the secondary transfer unit 80, adjustment of the conveyance speed of the registration roller pair 16 is started.

T301: As described in step S1601, the motor M1 stops upon the leading sheet reaching the first waiting position x0. Note that, since step S1601 is described as one step that comprehensively includes various kinds of conveyance control, this step may be partially executed after step S1602.

T302: As described in step S1603, the speed adjustment ends upon the leading end of the following sheet reaching the stable-speed point 202. The CPU 104 restores the conveyance speed of the registration roller pair 16 to the conveyance speed of the image forming unit. Also, as described in step S1604, the CPU 104 rotates the motor M1 in the forward direction and turns on the clutch CL2.

T303: Upon the trailing end of the leading sheet passing through the reverse point (reverse roller pair 50) as described in step S1605, the rotation of the motor M1 is switched from forward rotation to reverse rotation in step S1606. Thus, the reverse roller pair 50 prepares for the arrival of the following sheet.

T304: Upon the leading end of the leading sheet reaching the second waiting position x1 as described in step S1607, the clutch CL2 is disengaged, and in step S1608, power of the motor M3 is no longer transmitted to the conveyance roller pair 53.

T305: the following sheet with an image formed on the first face is conveyed toward the reverse point 201, and the leading end of the following sheet soon reaches the reverse point 201.

Note that, in the third embodiment, the CPU 104 starts to drive the motor M1 in accordance with the timing (T302) at which the speed adjustment for the following sheet ends, as shown in FIG. 17. However, the present invention is not limited thereto. For example, the CPU 104 may also start to drive the motor M1 before the speed adjustment for the following sheet ends. Conveyance of the leading sheet may be started while the speed of the registration roller pair 16 is being restored to the processing speed, and the speed adjustment may be completed at the timing at which the leading end of the leading sheet reaches the conveyance roller pair 53. In this case, the timing at which the CPU 104 starts to drive the motor M1 is obtained from a distance in the sub-conveyance path r2 between the leading end position of the leading sheet that is waiting at the first waiting position x0 and the conveyance roller pair 53.

Note that the third embodiment has described the control to increase or decrease, using the registration roller pair 16, the conveyance speed (feeding speed) of a sheet fed from the feed cassette 13, and again restore this conveyance speed to the conveyance speed (processing speed) of the image forming unit. Here, the feeding speed, i.e. the conveyance speed of a sheet before being increased or decreased by the registration roller pair 16 does not necessarily need to be the same as the processing speed. The feeding speed may be different from the processing speed.

In the case of the control according to the third embodiment, the sheet conveyance speed is changed twice. However, the present invention is not limited thereto. As an example, it is assumed that the conveyance speed of a sheet fed from the feed cassette 13 is different from the processing speed. The CPU 104 changes the timing of restoring the sheet conveyance speed to the processing speed based on the timing at which the leading end of the sheet was detected by the sheet sensor 62. Thus, the position of a sheet that is being conveyed can be aligned with an image formed on the intermediate transfer belt 8. In the case of this control, the sheet conveyance speed need only be changed once.

Modifications

The timing of feeding a following sheet may be set to be later than that in the third embodiment, in relation to the design. In this case, a leading sheet arrives at the first waiting position x0 before the following sheet reaches the registration roller pair 16. That is to say, the CPU 104 continues to convey the leading sheet without stopping the leading sheet at the first waiting position x0. This is because the speed adjustment of the registration roller pair 16 is not started until the following sheet reaches the registration roller pair 16. However, upon the following sheet reaching the registration roller pair 16, conveyance of the leading sheet needs to be suspended. This can be realized by the aforementioned clutch CL2.

Figure 18:
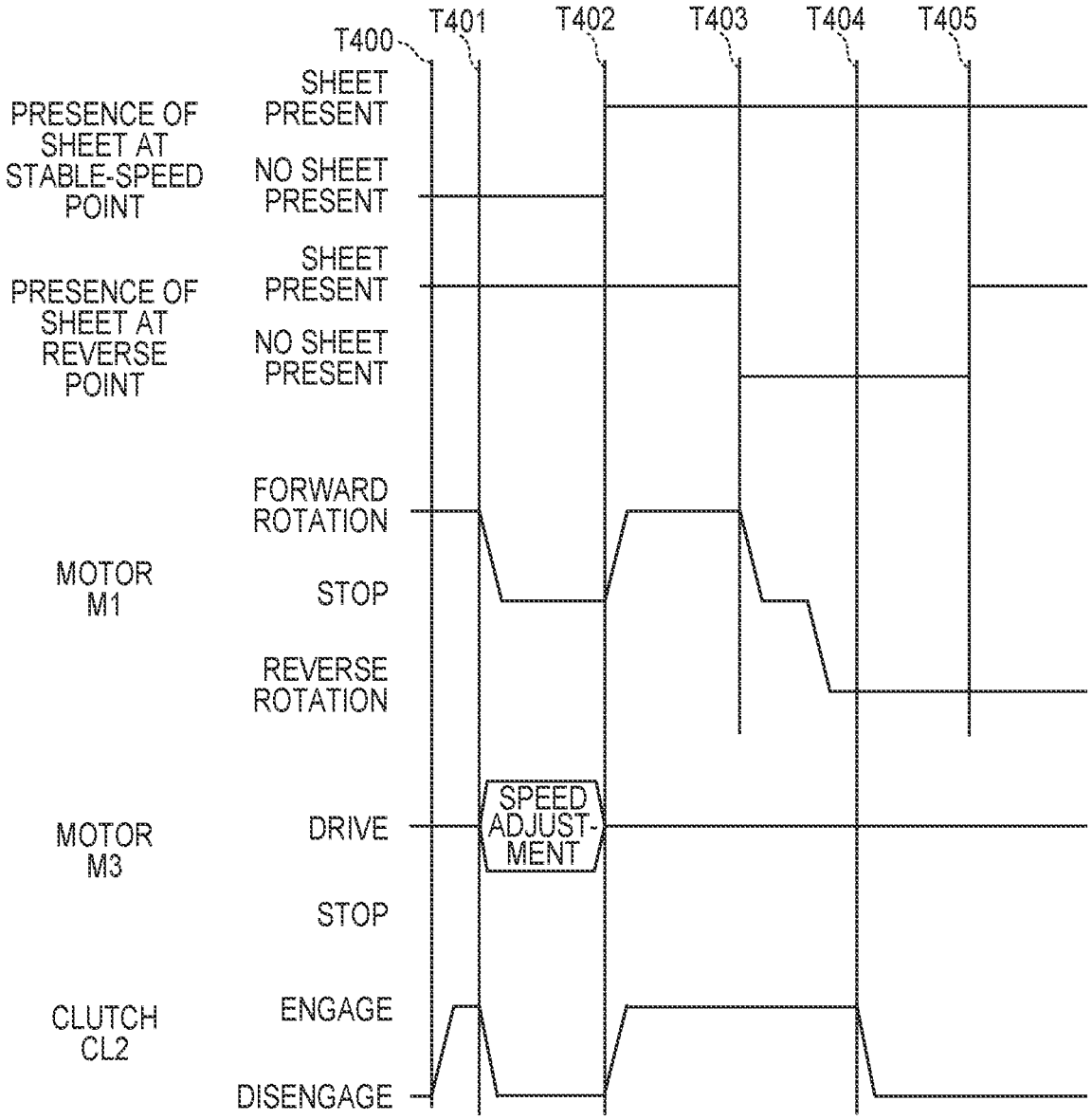
FIG. 18 is a timing chart depicting sheet conveyance control.

FIG. 18 is a timing chart depicting conveyance control in the case where the timing of feeding a following sheet is set to be late.

T400: The CPU 104 conveys a leading sheet that has been pulled into the reverse unit 70, downward in the sub-conveyance path r2 by rotating the motor M1 in the forward direction and turning on the clutch CL2. Note that the timing of turning on the clutch CL2 may be when the leading end of the leading sheet reaches the first waiting position x0. The leading end of the leading sheet passes through the first waiting position x0 and the competing point 203, and further moves toward the second waiting position x1. That is to say, in the modification, the sheet does not stop at the first waiting position x0.

T401: Upon the following sheet arriving at the registration roller pair 16, the CPU 104 switches off the clutch CL2 and starts to adjust the conveyance speed of the registration roller pair 16. That is to say, the leading sheet stops when the leading end of the leading sheet reaches a position (suspending position) that is downstream of the conveyance roller pair 53 and is upstream of the second waiting position x1. This suspending position is also a waiting position. Note that the CPU 104 also stops the motor M1 during a period in which the conveyance speed is being adjusted. Thus, the leading sheet will be prevented from being folded due to the trailing end thereof being pressed downstream by the conveyance roller pair 52.

T402: Upon the leading end of the following sheet reaching the stable-speed point 202, the CPU 104 ends the speed adjustment. The CPU 104 restores the conveyance speed of the registration roller pair 16 to the conveyance speed of the image forming unit. Also, the CPU 104 again rotates the motor M1 in the forward direction and turns on the clutch CL2. Thus, conveyance of the leading sheet along the sub-conveyance path r2 is resumed.

T403: Upon the trailing end of the leading sheet passing through the reverse point (reverse roller pair 50), the CPU 104 switches the rotation of the motor M1 from forward rotation to reverse rotation. Thus, the reverse roller pair 50 prepares for arrival of the following sheet.

T404: Upon the leading end of the leading sheet reaching the second waiting position x1, the CPU 104 disengages the clutch CL2. As a result, power of the motor M3 is no longer transmitted to the conveyance roller pair 53, the leading end of the leading sheet stops at the second waiting position x1, and the leading sheet stops in the sub-conveyance path r2.

T405: The following sheet with an image formed on the first face is conveyed toward the reverse point 201, and the leading end of the following sheet soon reaches the reverse point 201.

In such cases where the timing of feeding the following sheet is set to be late in relation to the design, the CPU 104 may convey the leading sheet further downstream without stopping the leading sheet at the first waiting position x0. However, upon the leading end of the following sheet arriving at the registration roller pair 16, the CPU 104 turns off the clutch CL2 and stops the motor M1, thereby suspending conveyance of the leading sheet. With this configuration, a load on the leading sheet will not be generated due to a difference in the conveyance speed between the conveyance roller pairs 51 and 53.

Length of Sub-Conveyance Path

Figure 19A:
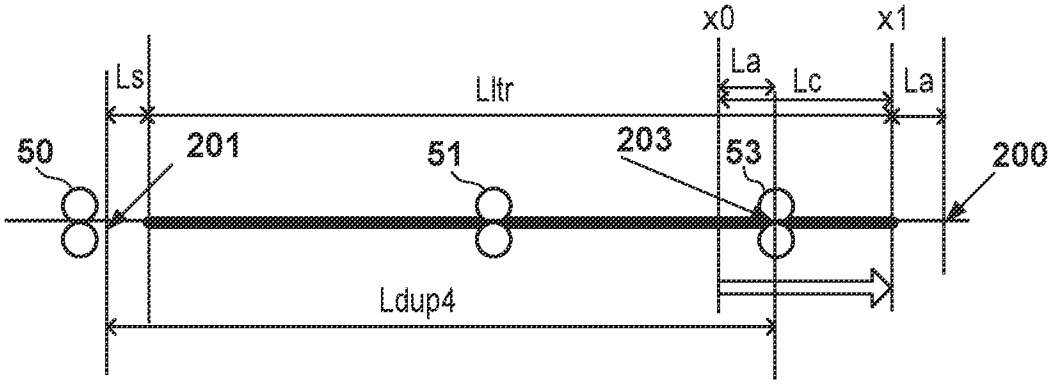
FIGS. 19A to 19C are diagrams showing the length of a sub-conveyance path.
Figure 19B:
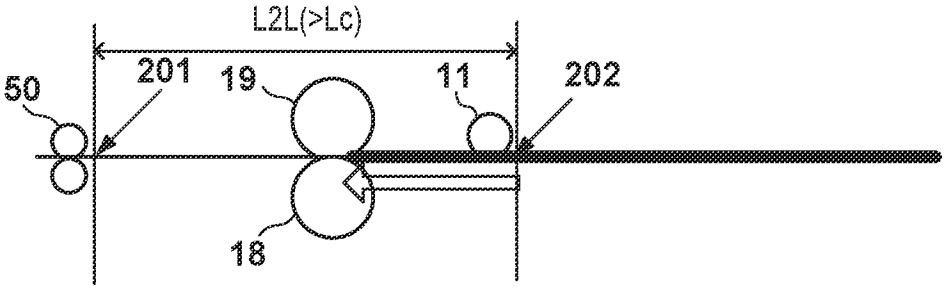

FIG. 19A shows a waiting state of a leading sheet in the sub-conveyance path r2 according to the third embodiment. FIG. 19B shows the position of a following sheet when the leading sheet is conveyed to the merging point 200. In the case of Letter sheets, the leading end of the leading sheet stops for the first time at the first waiting position x0. The first waiting position x0 is a position upstream of the competing point 203 by a distance La. Upon the leading end of the following sheet reaching the stable-speed point 202, conveyance of the leading sheet is resumed, and the leading sheet stops for the second time at the second waiting position x1. The second waiting position x1 is a position upstream of the merging point 200 by the distance La. Here, the distance La is obtained based on the result of measurement of a variation in sheet conveyance and the simulation result. As shown in FIG. 19A, the distance Ls from the trailing end of the Letter sheet whose leading end is positioned at the second waiting position x1 to the reverse point 201 is also determined while giving consideration to a variation in conveyance. That is to say, Ls is determined so that the trailing end is positioned downstream of the reverse point 201 even if an expected variation in conveyance occurs.

The distance Ldup4 from the competing point 203 and the reverse point 201 is expressed by the following equation.

$$Ldup4=Lltr+Ls-Lc+La \quad (3)$$

Here, Lc denotes the distance between the first waiting position x0 and the second waiting position x1. Lc is a distance that is shorter than the distance L2 from the stable-speed point 202 to the reverse point 201 shown in FIG. 19B.

Figure 19C:
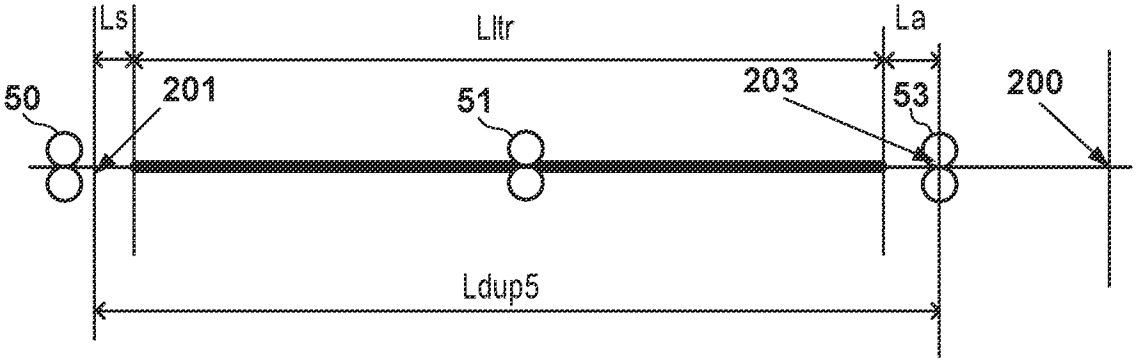

FIG. 19C shows the size of the sub-conveyance path r2 in the comparative example shown in FIG. 15. In the comparative example, the trailing end of the leading sheet needs to be positioned downstream of the reverse point 201. The conveyance path length Ldup5 is determined by this constraint.

$$Ldup5=La+Lltr+Ls \quad (4)$$

Accordingly, the sub-conveyance path length in the third embodiment is shorter than the sub-conveyance path length in the comparative example by the length Lc.

Although the number of sheets to be circulated is two in the third embodiment, three or more sheets may be circulated. That is to say, the present invention is applicable to the case where the leading sheet is present at the reverse point 201 when the leading end of the following sheet has passed through the stable-speed point 202. In this case, the trailing end of the leading sheet need only pass through the reverse point 201 until the leading end of the following sheet reaches the reverse point 201. That is to say, yet another sheet may be present in the sub-conveyance path r2.

In the third embodiment, the CPU 104 may change the number of sheets to be circulated in accordance with the sheet length. For example, the CPU 104 may set the number of sheets to be circulated to three if the sheet length is equal to or shorter than a predetermined length, and may set the number of sheets to be circulated to two if the sheet length is longer than the predetermined length. The predetermined length to serve as a threshold value may be set in accordance with the length of the conveyance path.

Also, the third embodiment may employ a configuration in which the conveyance roller pair 51 is omitted, and sheets are directly conveyed from the reverse roller pair 50 to the conveyance roller pair 53.

The image forming method is not limited to an electrophotographic method, and may also be an inkjet method or the like.

Summary

According to the above embodiments, the feeding apparatus 12 is an example of a feeding unit that feeds sheets to the main conveyance path r1. The exposure apparatus 7, the process cartridges, and the secondary transfer unit 80 are examples of an image forming unit that forms an image on a sheet conveyed along the main conveyance path r1. The reverse unit 70, which includes the reverse roller pair 50, is an example of a reverse unit that pulls in a sheet conveyed along the main conveyance path r1, and feeds this sheet to the sub-conveyance path r2 by turning over the conveyance direction of the sheet. The reverse unit 70 is also an example of a reverse unit that pulls in a sheet on which an image has been formed by the image forming unit and that has been conveyed from the main conveyance path, and turns over the conveyance direction of the sheet to feed the sheet to the sub-conveyance path after the trailing end of the sheet has passed through a branch point of the main conveyance path and the sub-conveyance path. The conveyance roller pairs 51, 52, 53, and the like are examples of a conveyance unit that conveys, to the main conveyance path r1, the sheet that has been fed to the sub-conveyance path r2. The conveyance roller pairs 51, 52, and 53 and the like are examples of a conveyance unit that conveys a sheet that has been fed to the sub-conveyance path by the reverse unit, again to the main conveyance path from a merging point of the sub-conveyance path and the main conveyance path. The CPU 104 and the motor driving unit 111 are examples of a control unit that controls the reverse unit and the conveyance unit. The CPU 104 and the motor driving unit 111 are examples of a control unit that controls the reverse unit and the conveyance unit so as to cause a first sheet that is fed to the sub-conveyance path by the reverse unit to wait in the sub-conveyance path while straddling the branch point.

As shown in FIG. 5D and other diagrams, the CPU 104 controls the reverse unit and the conveyance unit so as to cause a first sheet P1 to wait on the downstream side in the sub-conveyance path r2, and so as to cause a second sheet P to wait so that it may obstruct the reverse point 201. This configuration shortens the sub-conveyance path length and reduces the size of the image forming apparatus. The reverse point 201 is an example of a connecting portion that is located on the upstream side in the sub-conveyance path r2 and connects the main conveyance path r1, the sub-conveyance path r2, and the reverse unit.

The CPU 104 resumes conveying the first sheet P1 and the second sheet P2 downstream of the sub-conveyance path r2 after the trailing end of a third sheet P that has been fed from the feeding unit has passed through a merging portion of the main conveyance path r1 and the sub-conveyance path r2 until the leading end of the third sheet P3 reaches the connecting portion. With this control, the sheets are unlikely to come into contact with each other even if the sub-conveyance path length is shortened. Note that, in the case of employing the two-sheet circulating mode, the first sheet and the second sheet are the same sheet. In a circulating mode of circulating four or more sheets in a circular path, one or more sheets are present between the first sheet and the second sheet.

According to the above embodiments, the maximum number of sheets that can be simultaneously accommodated in the circular path formed by the reverse unit 70, the sub-conveyance path r2, and the main conveyance path r1 is N. N is an integer that is 2 or greater. While the trailing end of the third sheet P3 is passing through the merging point 200, the second sheet P2 is waiting while spanning the reverse unit 70 and the reverse point 201. That is to say, the reverse point 201, which is an exit of the main conveyance path r1 and is also an entrance of the reverse unit 70, is obstructed by the second sheet P2. Also, (N−1) sheets, which are N sheets excluding the third sheet P3, are waiting in the sub-conveyance path r2.

The length Ldup of the sub-conveyance path r2 is the length from the reverse point 201 to the merging point 200. In the first embodiment, the length Ldup1 of the sub-conveyance path r2 is shorter than the sum of the total length of the (N−1) sheets, the total length of gaps between adjacent sheets among the (N−1) sheets, and the distance from the merging point 200 to the waiting position at which the leading end of the first sheet P1 is waiting. This is shown as an example in FIG. 8A. Accordingly, referring to FIG. 8A, a trailing end area of the second sheet P2, which is the rearmost sheet, is positioned upstream of the reverse point 201. This configuration shortens the sub-conveyance path length.

The CPU 104 may also cause the conveyance unit to convey a waiting first sheet to the main conveyance path after the trailing end of a second sheet, which follows the first sheet fed from the feeding unit, has passed through the merging point, and may move the trailing end of the first sheet downstream of the branch point before the second sheet reaches the branch point. The CPU 104 may also control the reverse unit and the conveyance unit so as to cause the conveyance unit to convey the waiting first sheet to the main conveyance path, and thereafter cause the first sheet to wait again upstream of the image forming unit.

The CPU 104 may also have a first detection unit that detects a sheet that passes through the merging point 200. The first detection unit may be a sheet sensor that is provided at the merging point 200. The first detection unit may be a counter that counts the number of drive pulses supplied to a motor that involves sheet conveyance. The CPU 104 detects that the leading end of a sheet has arrived at the merging point 200 or that the trailing end thereof has passed therethrough if the counter value reaches a predetermined value that corresponds to the merging point 200. The registration roller pair 16 is an example of a registration roller that is provided in the main conveyance path r1 and feeds a sheet into the image forming unit.

The CPU 104, upon recognizing, based on the detection result from the first detection unit, that the trailing end of a third sheet P3 that is being conveyed by the registration roller pair 16 has passed through the merging point 200, resumes driving the conveyance unit to feed the first sheet P from the sub-conveyance path r2 into the main conveyance path r1. Thus, the CPU 104 can further convey the second sheet P2 that has obstructed the reverse point 201 downstream, and clear the reverse point 201. Note that, upon the leading end of the first sheet reaching the registration roller pair 16, the CPU 104 may stop the conveyance of the first sheet P1 and the second sheet P2 by the conveyance unit. This is for synchronizing the timing at which the first sheet P1 arrives at the secondary transfer unit 80 with the timing at which toner images arrive thereat.

The CPU 104 moves the second sheet P2 downstream of the sub-conveyance path r2 by rotating the reverse roller pair 50, which is a roller in the reverse unit 70, in a forward direction, based on the trailing end of a third sheet P3 that is being conveyed by the registration roller pair 16 passing through the merging point 200. Also, upon the trailing end of the second sheet P2 passing through the reverse unit 70 and the reverse point 201, the CPU 104 rotates the roller in the reverse unit 70 in a reverse direction. Thus, preparations for receiving the third sheet P3 at the reverse unit 70 are complete.

The CPU 104 may also have a second detection unit that detects sheets that pass through the reverse point 201. The second detection unit may be a sheet sensor 61 that detects a sheet passing through the reverse point 201. The second detection unit may also be a counter that counts the number of drive pulses supplied to a motor that involves sheet conveyance. Upon the counter value reaching a predetermined value that corresponds to the merging point 200, the CPU 104 detects that the leading end of a sheet has arrived at the reverse point 201, or that the trailing end thereof has passed therethrough. The CPU 104 may also recognize, based on the detection result from the second detection unit, that the trailing end of a second sheet P that is moving downstream of the sub-conveyance path r2 has passed through the reverse point 201.

The CPU 104 may also prohibit the feeding of sheets by the feeding apparatus 12 after resuming driving the conveyance roller pair 53 to feed the first sheet P1 to the main conveyance path r1. It is thus possible to avoid contact between a sheet that has been fed from the feeding apparatus 12 and a sheet that has been fed again from the sub-conveyance path r2.

The CPU 104 may also set the number of sheets to wait in the sub-conveyance path to two if the sheet length in the sheet conveyance direction is equal to or shorter than a predetermined length, and may also set the number of sheets to wait in the sub-conveyance path to one if the sheet length in the sheet conveyance direction is longer than the predetermined length. Note that the distance from the merging point to the branch point in the main conveyance direction may also be longer than the sheet length in the sheet conveyance direction.

As described regarding FIG. 10, the CPU 104 may also determine the timing of resuming conveying (N−1) sheets that are waiting in the sub-conveyance path r2, in accordance with the type of the second sheet P2 that is waiting at the rear of the (N−1) sheets. For example, if the second sheet is a sheet with low conveyance efficiency, the CPU 104 resumes conveying the (N−1) sheets that are waiting in the sub-conveyance path r2, when the trailing end of a third sheet has passed through the merging point 200. If the second sheet is a sheet with high conveyance efficiency, the CPU 104 resumes conveying the (N−1) sheets that are waiting in the sub-conveyance path r2, when the trailing end of a third sheet that is moving toward the reverse unit 70 has passed through the reverse point 201. As a result, preceding feeding is executed in the case of a sheet of a type with relatively low conveyance efficiency, such as thick paper or gloss paper, and accordingly, contact between sheets at the reverse point 201 is less likely to occur. In the case of a sheet of a type with high conveyance efficiency, such as plain paper or thin paper, preceding feeding may not be executed. This is because a sheet of a type with high conveyance efficiency is unlikely to obstruct the reverse point 201.

As shown in FIG. 5A and other diagrams, the distance of a section from the merging point 200 to the reverse point 201 in the main conveyance path r1 is longer than the sheet length in the sheet conveyance direction. As a result, an $N^{th}$ sheet can move along the main conveyance path r1 while (N−1) sheets are waiting in the sub-conveyance path r2.

As described regarding FIGS. 12 and 13, the conveyance roller pair 51 is an example of a first conveyance unit that conveys a sheet that has been fed to the sub-conveyance path r2 by the reverse unit 70. The conveyance roller pair 53 is an example of a second conveyance unit that is provided downstream of the first conveyance unit in the sheet conveyance direction in the sub-conveyance path r2, and conveys sheets to the merging point 200 of the sub-conveyance path r2 and the main conveyance path r1. The registration roller pair 16 is an example of a third conveyance unit that is provided in the main conveyance path r1 between the merging point 200 and the secondary transfer unit 80, which is an image forming unit, and conveys sheets while variably adjusting the sheet conveyance speed. The motor M3 is an example of a first drive unit that drives the second conveyance unit and the third conveyance unit. The CPU 104 is an example of a control unit that controls the reverse unit 70, the first conveyance unit, and the first drive unit. As shown in FIG. 14C, the CPU 104 causes a sheet that has been fed to the sub-conveyance path r2 by the reverse unit 70 to wait at the first waiting position x0, which is located upstream of the second conveyance unit, in the sub-conveyance path r2, until the variable adjustment of the conveyance speed of the third conveyance unit is completed. Upon the variable adjustment of the conveyance speed of the third conveyance unit being completed, the CPU 104 conveys the sheet downstream of the second conveyance unit. As a result, the load applied to a sheet by the conveyance roller pairs 51 and 53 whose conveyance speeds are temporarily different is reduced.

Upon the variable adjustment of the conveyance speed of the third conveyance unit by the third conveyance unit being completed, the CPU 104 conveys a sheet that has been waiting at the first waiting position x0 to the second waiting position x1, which is located downstream from the second conveyance unit, and causes this sheet to wait at the second waiting position x1. Thus, the following sheet can move toward the reverse unit 70 without coming into contact with the leading sheet, as shown in FIG. 14F.

The clutch CL2 is an example of a clutch that engages and disengages the second conveyance unit with respect to the first drive unit. The CPU 104 causes a sheet to wait at the second waiting position x1 by causing the clutch CL2 to disengage the first drive unit from the second conveyance unit. Thus, the registration roller pair 16 and the conveyance roller pair 53 can be driven by a single motor, and the number of motors can be reduced.

As shown in FIG. 13, the motor M1 is an example of a second drive unit that drives the reverse unit 70 and the first conveyance unit (e.g. conveyance roller pair 51). The clutch CL1 is an example of a one-way clutch that transmits the driving force of the second drive unit to the first conveyance unit if the second drive unit is rotating in the forward direction, and does not transmit the driving force of the second drive unit to the first conveyance unit if the second drive unit is rotating in the reverse direction. Thus, the reverse roller pair 50 and the conveyance roller pair 51 can be driven by a single motor, and accordingly, the number of motors can be reduced. That is to say, even if the reverse roller pair 50 and the conveyance roller pair 51 are driven by a single motor, the reverse rotation of the reverse roller pair 50 can be started early by employing a one-way clutch. Note that the clutches CL1 and CL2 may also be electromagnetic clutches that are switched between an engaging state and a disengaging state by a solenoid or the like.

As shown in FIG. 16, the CPU 104 rotates the second drive unit in the reverse direction upon the trailing end of the rearmost sheet in the sub-conveyance path r2 having been conveyed downstream, in the sub-conveyance path r2, of the reverse point 201 that connects the main conveyance path r1, the sub-conveyance path r2, and the reverse unit 70. Thus, preparations for receiving a following sheet at the reverse unit 70 are complete. Note that, as shown in FIG. 19A, the sheet length in the sheet conveyance direction may also be shorter than or equal to the distance from the entrance of the sub-conveyance path r2 to the second waiting position.

Note that the registration roller pair 16 is also an example of a first conveyance unit that changes the conveyance speed of a sheet fed from the feeding unit from a first speed to a second speed, and convey the sheet along the main conveyance path. The exposure apparatus 7, the process cartridges, and the secondary transfer unit 80 are examples of an image forming unit that forms an image on a sheet that is conveyed at the second speed from the first conveyance unit. The reverse unit 70 is an example of a reverse unit that pulls in a sheet on which an image has been formed by the image forming unit and that has been conveyed from the main conveyance path, and turns over the conveyance direction of the sheet to feed the sheet to the sub-conveyance path after the trailing end of the sheet has passed through a branch point of the main conveyance path and the sub-conveyance path. The conveyance roller pair 53 is an example of a second conveyance unit that again conveys a sheet that has been fed to the sub-conveyance path by the reverse unit, from the sub-conveyance path to the main conveyance path. The motor M3 is an example of a driving source that drives the first conveyance unit and the second conveyance unit. The CPU 104 is an example of a control unit that controls the reverse unit and the second conveyance unit so as to cause a first sheet that is fed to the sub-conveyance path by the reverse unit to wait upstream of the second conveyance unit in the sub-conveyance path. The CPU 104 may also cause the reverse unit to convey a waiting first sheet to the second conveyance unit in accordance with the timing at which the first conveyance unit completes the changing of the conveyance speed of a second sheet that follows the first sheet from the first speed to the second speed, and move the trailing end of the first sheet downstream of the branch point before the second sheet reaches the branch point. The CPU 104 may also control the reverse unit and the second conveyance unit so as to cause the reverse unit to convey a waiting first sheet downstream of the second conveyance unit, and thereafter cause the first sheet to wait again upstream of the merging point of the sub-conveyance path and the main conveyance path. The clutch CL2 is an example of a clutch that that transmits or disengages the driving force of the driving source to/from the second conveyance unit. The CPU 104 may also control the clutch so as to cause the first sheet to wait again upstream of the merging point by causing the clutch to disengage, from the second conveyance unit, the driving force of the driving source.

The conveyance roller pair 51 is an example of a third conveyance unit that conveys, to the second conveyance unit, a sheet that has been fed to the sub-conveyance path by the reverse unit. The motor M1 is an example of a second driving source that drives the reverse unit and the third conveyance unit. The clutch CL1 is an example of a one-way clutch that transmits the driving force of the second driving source to the third driving conveyance unit if the second driving source is rotating in the forward direction, and does not transmit the driving force of the second driving source to the third conveyance unit if the second driving source is rotating in the reverse direction.

The sheet sensor 62 is an example of a detection unit that is provided between the feeding unit and the image forming unit and detects sheets that are conveyed along the main conveyance path. Based on the timing at which the leading end of a second sheet was detected by the detection unit, the CPU 104 may set the first speed, change the sheet conveyance speed of the first conveyance unit from the second speed to the first speed, and further change the sheet conveyance speed from the first speed to the second speed.

As described regarding the modification, there may be an image forming apparatus in which variable adjustment of the conveyance speed of the registration roller pair 16 is started while a sheet that has been fed to the sub-conveyance path r2 by the reverse unit 70 is being conveyed by the conveyance roller pair 53. In this case, the CPU 104 suspends the sheet conveyance by causing the clutch CL2 to disengage the conveyance roller pair 53 from the motor M3. Upon the variable adjustment of the conveyance speed of the registration roller pair 16 being completed, the CPU 104 resumes conveying sheets by causing the clutch CL2 to engage the motor M3 to the conveyance roller pair 53. Furthermore, the CPU 104 again causes the clutch CL2 to disconnect the conveyance roller pair 53 from the motor M3 so that the leading end of a sheet stops at a waiting position that is located upstream of the merging point 200. As a result, the load applied to a sheet by the conveyance roller pairs 51 and 53 whose conveyance speeds are temporarily different is reduced.

When causing the clutch CL2 to disengage the conveyance roller pair 53 from the motor M3, the CPU 104 stops the forward rotation of the reverse unit 70 and the conveyance roller pair 51. When causing the clutch CL2 to engage the conveyance roller pair 53 to the motor M3, the CPU 104 resumes the forward rotation of the reverse unit 70 and the conveyance roller pair 51. Thus, the load applied to a sheet by the conveyance roller pairs 51 and 53 is reduced.

The CPU 104 temporarily increases or decreases the conveyance speed of the registration roller pair 16 to synchronize the timing at which a sheet arrives at a toner image transfer position with the timing at which the toner images arrive at the transfer position. When the conveyance speed of the registration roller pair 16 is matched with the conveyance speed of the image forming unit (intermediate transfer belt 8), the CPU 104 completes the variable adjustment of the conveyance speed of the registration roller pair 16. In the case where the registration roller pair 16 and the conveyance roller pair 53 are driven by the same motor, the conveyance speed of the conveyance roller pair 53 also temporarily increases or decreases. Consequently, a state where the conveyance speed of the conveyance roller pair 53 does not coincide with the conveyance speed of the conveyance roller pair 51 is entered, and a load may be applied to a sheet that is being conveyed while spanning the conveyance roller pair 53 and the conveyance roller pair 51. Accordingly, it is worthwhile applying this embodiment.

In the case where the first conveyance unit changes the sheet conveyance speed from the second speed to the first speed while the second conveyance unit is conveying a first sheet that has been fed to the sub-conveyance path by the reverse unit, the CPU 104 may also control the clutch so as to cause the clutch to disengage, from the second conveyance unit, the driving force of the driving source and cause the first sheet to wait in the sub-conveyance path. Here, the waiting first sheet straddles the branch point. The CPU 104 may also cause the clutch to transmit the driving force of the driving source to the second conveyance unit in accordance with the timing at which the first conveyance unit completes the changing of the conveyance speed of a second sheet that follows the first sheet from the first speed to the second speed, and move the trailing end of the first sheet downstream of the branch point before the second sheet reaches the branch point. The CPU 104 may also cause the second conveyance unit to convey a waiting first sheet, and thereafter cause the clutch to disengage, from the second conveyance unit, the driving force of the driving source, thereby causing the first sheet to wait again upstream of the merging point of the sub-conveyance path and the main conveyance path.

Note that numerals attached to the aforementioned technical terms, including "first", "second" and "third", are merely attached to distinguish between the same or similar technical terms. Each numeral may be replaced with another numeral. For example, the first conveyance unit may also be called the third conveyance unit. Numerals in the claims may coincide with, or differ from, numerals in the specification. For example, a first conveyance unit stated in the claims may be stated as a third conveyance unit. Thus, numerals themselves do not have any technical meanings.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2016-236242, filed Dec. 5, 2016 and 2017-192833, filed Oct. 2, 2017, which are hereby incorporated by reference herein in their entirety.

What is claimed is:

1. An image forming apparatus comprising:

a feeding roller configured to feed a sheet to a main conveyance path;

a printer configured to form an image on the sheet fed from the feeding roller;

a reverse roller configured to pull in the sheet on which the image has been formed by the printer, the sheet having been conveyed from the main conveyance path, and reverse a conveyance direction of the sheet to feed the sheet to a sub-conveyance path after a trailing end of the sheet has passed through a branch point of the main conveyance path and the sub-conveyance path;

a conveyance roller configured to again convey the sheet that has been fed to the sub-conveyance path by the reverse roller, to the main conveyance path from a merging point of the sub-conveyance path and the main conveyance path; and a controller circuit configured to control the reverse roller and the conveyance roller so as to cause a first sheet that is fed to the sub-conveyance path by the reverse roller to wait in the sub-conveyance path, wherein the first sheet that is waiting straddles the branch point, wherein the controller circuit causes the conveyance roller to convey the first sheet that is waiting in the sub-conveyance path to the main conveyance path after a trailing end of a second sheet that has been fed from the feeding roller and follows the first sheet has passed through the merging point, and moves a trailing end of the first sheet downstream of the branch point before the second sheet reaches the branch point, wherein the controller circuit is further configured to determine a timing of resuming conveying the first sheet that is waiting in the sub-conveyance path, in accordance with a type of the first sheet.

2. The image forming apparatus according to claim 1, wherein the controller circuit is further configured to control the conveyance roller so as to cause the conveyance roller to convey the first sheet that is waiting to the main conveyance path, and thereafter cause the first sheet to wait again upstream of the printer.

3. The image forming apparatus according to claim 1, further comprising:

a sensor configured to detect a sheet that passes through the merging point, wherein, upon the sensor detecting that the trailing end of the second sheet has passed through the merging point, the controller circuit resumes driving the conveyance roller to feed the first sheet from the sub-conveyance path to the main conveyance path.

4. The image forming apparatus according to claim 1, wherein, if the first sheet is a sheet with low conveyance efficiency, the controller circuit resumes conveying the first sheet that is waiting in the sub-conveyance path, when the trailing end of the second sheet passes through the merging point, and if the first sheet is a sheet with high conveyance efficiency, the controller circuit resumes conveying the first sheet that is waiting in the sub-conveyance path, when the trailing end of the second sheet that is moving toward the reverse roller passes through the branch point.

5. The image forming apparatus according to claim 1, wherein the controller circuit is further configured to set the number of sheets to wait in the sub-conveyance path to two if a length of the sheet in the conveyance direction of the sheet is equal to or shorter than a predetermined length, and the controller circuit is further configured to set the number of sheets to wait in the sub-conveyance path to one if the length of the sheet in the conveyance direction of the sheet is longer than the predetermined length.

6. An image forming apparatus comprising:

a feeding roller configured to feed a sheet to a main conveyance path;

a first conveyance roller configured to change a conveyance speed of the sheet fed from the feeding roller from a first speed to a second speed, and convey the sheet along the main conveyance path;

a printer configured to form an image on the sheet that is conveyed from the first conveyance roller at the second speed;

a reverse roller configured to pull in the sheet on which the image has been formed by the printer, the sheet having been conveyed from the main conveyance path, and reverses a conveyance direction of the sheet to feed the sheet to a sub-conveyance path after a trailing end of the sheet has passed through a branch point of the main conveyance path and the sub-conveyance path;

a second conveyance roller configured to again convey the sheet that has been fed to the sub-conveyance path by the reverse roller, from the sub-conveyance path to the main conveyance path;

a motor configured to drive the first conveyance roller and the second conveyance roller; and a controller circuit configured to control the reverse roller and the second conveyance roller so as to cause a first sheet that is fed to the sub-conveyance path by the reverse roller to wait upstream of the second conveyance roller in the sub-conveyance path, wherein the first sheet that is waiting straddles the branch point, wherein the controller circuit is further configured to cause the reverse roller to convey the first sheet that is waiting to the second conveyance roller in accordance with a timing at which the first conveyance roller completes changing of a conveyance speed of a second sheet that follows the first sheet from the first speed to the second speed, and move a trailing end of the first sheet downstream of the branch point before the second sheet reaches the branch point.

7. The image forming apparatus according to claim 6, wherein the controller circuit is further configured to control the reverse roller and the second conveyance roller so as to cause the reverse roller to convey the first sheet that is waiting, downstream of the second conveyance roller, and thereafter cause the first sheet to wait again upstream of a merging point of the sub-conveyance path and the main conveyance path.

8. The image forming apparatus according to claim 7, further comprising:

a clutch configured to transmit a driving force of the motor to the second conveyance roller and disengage the driving force of the second conveyance roller, wherein the controller circuit is further configured to control the clutch so as to cause the first sheet to wait again upstream of the merging point by causing the clutch to disengage the driving force of the motor from the second conveyance roller.

9. The image forming apparatus according to claim 6, further comprising:

a third conveyance roller configured to convey the sheet that has been fed to the sub-conveyance path by the reverse roller, to the second conveyance roller;

a second motor configured to drive the reverse roller and the third conveyance roller; and a one-way clutch configured to transmit the driving force of the second motor to the third conveyance roller while the second motor is rotating in a forward direction, and not transmit the driving force of the second motor to the third conveyance roller while the second motor is rotating in a reverse direction.

10. The image forming apparatus according to claim 6, further comprising:

a sensor configured to detect a sheet that is conveyed along the main conveyance path, the sensor being provided between the feeding roller and the printer, wherein, based on a timing at which a leading end of the second sheet is detected by the sensor, the controller circuit sets the first speed, changes the conveyance speed at which the first conveyance roller conveys the sheet from the second speed to the first speed, and further changes the conveyance speed of the sheet from the first speed to the second speed.

11. The image forming apparatus according to claim 6, wherein the controller circuit is further configured to set the number of sheets to wait in the sub-conveyance path to two if a length of the sheet in the conveyance direction of the sheet is equal to or shorter than a predetermined length, and set the number of sheets to wait in the sub-conveyance path to one if the length of the sheet in the conveyance direction of the sheet is longer than the predetermined length.

12. An image forming apparatus comprising:

a feeding roller configured to feed a sheet to a main conveyance path;

a first conveyance roller configured to change a conveyance speed of the sheet fed from the feeding roller from a second speed to a first speed, further changes the conveyance speed from the first speed to the second speed, and convey the sheet along the main conveyance path;

a printer configured to form an image on the sheet that is conveyed from the first conveyance roller at the second speed;

a reverse roller configured to pull in the sheet on which the image has been formed by the printer, the sheet having been conveyed from the main conveyance path, and reverse a conveyance direction of the sheet to feed the sheet to a sub-conveyance path after a trailing end of the sheet has passed through a branch point of the main conveyance path and the sub-conveyance path, a second conveyance roller configured to again convey the sheet that has been fed to the sub-conveyance path by the reverse roller, from the sub-conveyance path to the main conveyance path;

a motor configured to drive the first conveyance roller and the second conveyance roller;

a clutch configured to transmit a driving force of the motor to the second conveyance roller and disengage the driving force of the motor from the second conveyance roller; and a controller circuit configured to control the clutch so as to cause the clutch to disengage, from the second conveyance roller, the driving force of the motor and cause a first sheet that has been fed to the sub-conveyance path by the reverse roller to wait in the sub-conveyance path in a case where the first conveyance roller changes the conveyance speed of the sheet from the second speed to the first speed while the second conveyance roller is conveying the first sheet, wherein the first sheet that is waiting straddles the branch point, wherein the controller circuit is further configured to cause the clutch to transmit the driving force of the motor to the second conveyance roller in accordance with a timing at which the first conveyance roller completes changing of the conveyance speed of a second sheet that follows the first sheet from the first speed to the second speed, and move a trailing end of the first sheet downstream of the branch point before the second sheet reaches the branch point.

13. The image forming apparatus according to claim 12, wherein the controller circuit is further configured to control the second conveyance roller and the clutch so as to cause the first sheet to wait again upstream of a merging point of the sub-conveyance path and the main conveyance path, by causing the second conveyance roller to convey the first sheet that is waiting, and thereafter causing the clutch to disengage, from the second conveyance roller, the driving force of the motor.

14. The image forming apparatus according to claim 12, further comprising:

a third conveyance roller configured to convey the sheet that has been fed to the sub-conveyance path by the reverse roller, to the second conveyance roller;

a second motor configured to drive the reverse roller and the third conveyance roller; and a one-way clutch configured to transmit a driving force of the second motor to the third conveyance roller if the second motor is rotating in a forward direction, and not transmit the driving force of the second motor to the third conveyance roller if the second motor is rotating in a reverse direction.

15. The image forming apparatus according to claim 12, further comprising:

a sensor configured to detect a sheet that is conveyed along the main conveyance path, the sensor being provided between the feeding roller and the printer, wherein, based on a timing at which a leading end of the second sheet is detected by the sensor, the controller circuit sets the first speed, changes the conveyance speed at which the first conveyance roller conveys the sheet from the second speed to the first speed, and further changes the conveyance speed from the first speed to the second speed.

16. The image forming apparatus according to claim 12, wherein the controller circuit is further configured to set the number of sheets to wait in the sub-conveyance path to two if a length of the sheet in the conveyance direction of the sheet is equal to or shorter than a predetermined length, and set the number of sheets to wait in the sub-conveyance path to one if the length of the sheet in the conveyance direction of the sheet is longer than the predetermined length.

* * * * *